US010913304B2

(12) United States Patent
Seguchi

(10) Patent No.: US 10,913,304 B2
(45) Date of Patent: Feb. 9, 2021

(54) INK JET RECORDING METHOD, INK JET RECORDING APPARATUS, AND TREATMENT LIQUID

(71) Applicant: Seiko Epson Corporation, Tokyo (JP)

(72) Inventor: Kenichi Seguchi, Okaya (JP)

(73) Assignee: Seiko Epson Corporation

( * ) Notice: Subject to any disclaimer, the term of this patent is extended or adjusted under 35 U.S.C. 154(b) by 0 days.

(21) Appl. No.: 16/728,113

(22) Filed: Dec. 27, 2019

(65) Prior Publication Data

US 2020/0207140 A1 Jul. 2, 2020

(30) Foreign Application Priority Data

Dec. 28, 2018 (JP) ..... 2018-248009

(51) Int. Cl.
*B41M 7/00* (2006.01)
*B41J 11/00* (2006.01)

(52) U.S. Cl.
CPC ..... *B41M 7/0018* (2013.01); *B41J 11/002* (2013.01)

(58) Field of Classification Search
CPC ..... B41J 11/002; B41M 7/0018
See application file for complete search history.

(56) References Cited

U.S. PATENT DOCUMENTS

2017/0297347 A1* 10/2017 Torisaka ..... C09D 11/54
2018/0361731 A1* 12/2018 Kameshima ..... B41J 2/0057

FOREIGN PATENT DOCUMENTS

JP 2017-043701 A 3/2017

* cited by examiner

*Primary Examiner* — Lamson D Nguyen
(74) *Attorney, Agent, or Firm* — Harness, Dickey & Pierce, P.L.C.

(57) ABSTRACT

An ink jet recording method includes a treatment liquid attachment step, in which a treatment liquid containing at least one flocculant is attached to a recording medium, and an ink attachment step, in which an aqueous ink composition is attached to the recording medium. The treatment liquid attachment step and the ink attachment step are performed through multiple main scans and multiple sub-scans. A main scan is a movement of a recording head in a main scanning direction, and a sub-scan is a movement of the recording medium in a sub-scanning direction, which crosses the main scanning direction. The recording head has a first ejecting nozzle group, which is a line of nozzles arranged in the sub-scanning direction and ejects the treatment liquid, and a second ejecting nozzle group, which is a line of nozzles arranged in the sub-scanning direction and ejects the aqueous ink composition. The first ejecting nozzle group overlaps, at least in a portion, the second ejecting nozzle group when projected in the main scanning direction. When the treatment liquid is tested using a rigid-body pendulum characteristics tester at 35.0° C. for 20.0 minutes, the minimum oscillation period of the rigid-body pendulum is 70.0% or more of the maximum oscillation period of the rigid-body pendulum.

15 Claims, 5 Drawing Sheets

INK JET RECORDING METHOD, INK JET RECORDING APPARATUS, AND TREATMENT LIQUID

The present application is based on, and claims priority from, JP Application Serial Number 2018-248009, filed Dec. 28, 2018, the disclosure of which is hereby incorporated by reference herein in its entirety.

BACKGROUND

1. Technical Field

The present disclosure relates to an ink jet recording method, an ink jet recording apparatus, and a treatment liquid.

2. Related Art

Ink jet recording method is a method in which droplets of ink are ejected from very thin nozzles and attached to a recording medium to produce a recording. A feature of this method is that a high-resolution and high-quality image can be recorded quickly and with a relatively affordable system.

For example, studies are ongoing on printing with an aqueous ink by ink jetting, for example on a film. The aqueous ink can be an ink that is water-based and contains, for example, a colorant and a resin. For example, JP-A-2017-043701 discloses an ink set, a recording method, etc., in which a reactant containing a flocculant is used to flocculate substances in an ink and thereby to form an image.

Using a reactant as in the technology described in JP-A-2017-043701 hopefully helps obtain an image with reduced bleed because the reactant helps flocculate components of the ink quickly. The use of a reactant in image formation, however, can affect image quality by producing white spots (hereinafter also referred to as "white haze" on the surface of the image.

SUMMARY (1) A form of an ink jet recording method according to an aspect of the present disclosure includes a treatment liquid attachment step including attaching a treatment liquid containing at least one flocculant to a recording medium, and an ink attachment step including attaching an aqueous ink composition to the recording medium. The treatment liquid attachment step and the ink attachment step are performed through multiple main scans and multiple sub-scans. A main scan is a movement of a recording head in a main scanning direction, and a sub-scan is a movement of the recording medium in a sub-scanning direction as a direction crossing the main scanning direction. The recording head has a first ejecting nozzle group as a line of nozzles arranged in the sub-scanning direction and configured to eject the treatment liquid, and a second ejecting nozzle group as a line of nozzles arranged in the sub-scanning direction and configured to eject the aqueous ink composition. The first ejecting nozzle group overlaps, at least in a portion, the second ejecting nozzle group when projected in the main scanning direction. When the treatment liquid is tested using a rigid-body pendulum characteristics tester at 35.0° C. for 20.0 minutes, the minimum oscillation period of the rigid-body pendulum is 70.0% or more of the maximum oscillation period of the rigid-body pendulum.

(2) In form (1) above, the treatment liquid may be an aqueous treatment liquid and contain an organic solvent in an amount of 25.0% by mass or more of the total mass of the treatment liquid.

(3) In form (1) or (2) above, the treatment liquid may contain the flocculant in an amount of 4.0% by mass or more and 20.0% by mass or less of the total mass of the treatment liquid.

(4) In any of forms (1) to (3) above, the treatment liquid may contain one or two or more of polyvalent metal salts, cationic polymers, and organic acids as the flocculant.

(5) In any of forms (1) to (4) above, in a region of the recording medium, the amount of the treatment liquid attached thereto may be 10.0% by mass or more of the amount of the aqueous ink composition attached thereto.

(6) In any of forms (1) to (5) above, the recording method may further include a postheating step, after the treatment liquid attachment step and the ink attachment step, including heating the recording medium with the attached treatment liquid and aqueous ink composition thereon. The surface temperature of the recording medium in the postheating step may be 80.0° C. or more.

(7) In any of forms (1) to (6) above, the recording method may further include a drying step including drying, using a drying mechanism, the aqueous ink composition and treatment liquid attached to the recording medium in the ink attachment step and the treatment liquid attachment step, respectively.

(8) In form (7) above, the drying mechanism may include an aeration drying mechanism.

(9) In any of forms (1) to (8) above, the surface temperature of the recording medium in the treatment liquid attachment step may be 45.0 or less.

(10) In any of forms (1) to (9) above, the treatment liquid may contain a nitrogen-containing solvent.

(11) In any of forms (1) to (10) above, the percentage, in the treatment liquid, of organic solvents having a normal boiling point exceeding 280.0° C. is 1.0% by mass or less.

(12) In any of forms (1) to (11) above, the recording medium may be a low-absorbent recording medium or non-absorbent recording medium.

(13) In any of forms (1) to (12) above, the aqueous ink composition may be a black ink.

(14) A form of an ink jet recording apparatus according to an aspect of the present disclosure includes a recording head having a first ejecting nozzle group as a line of nozzles arranged in a sub-scanning direction as a direction of movement of a recording medium and configured to eject a treatment liquid, and a second ejecting nozzle group as a line of nozzles arranged in the sub-scanning direction and configured to eject an aqueous ink composition. When the treatment liquid is tested using a rigid-body pendulum characteristics tester at 35.0° C. for 20.0 minutes, the minimum oscillation period of the rigid-body pendulum is 70.0% or more of the maximum oscillation period of the rigid-body pendulum. The recording head, when performing a recording job, attaches the treatment liquid and the aqueous ink composition to the recording medium through multiple main scans and multiple sub-scans. A main scan is a movement of the recording head in a main scanning direction as a direction crossing the sub-scanning direction, and a sub-scan is a movement of the recording medium in the sub-scanning direction. The second ejecting nozzle group overlaps, at least in a portion, the first ejecting nozzle group when projected in the main scanning direction.

(15) A form of a treatment liquid according to an aspect of the present disclosure is a treatment liquid containing a flocculant. When the treatment liquid is tested using a rigid-body pendulum characteristics tester at 35.0° C. for 20.0 minutes, the minimum oscillation period of the rigid-body pendulum is 70.0% or more of the maximum oscillation period of the rigid-body pendulum. The treatment liquid is for use in an ink jet recording method. The ink jet recording method includes a treatment liquid attachment step including attaching the treatment liquid to a recording medium, and an ink attachment step including attaching an aqueous ink composition to the recording medium. The treatment liquid attachment step and the ink attachment step are performed through multiple main scans and multiple sub-scans. A main scan is a movement of a recording head in a main scanning direction, and a sub-scan is a movement of the recording medium in a sub-scanning direction as a direction crossing the main scanning direction. The recording head has a first ejecting nozzle group as a line of nozzles arranged in the sub-scanning direction and configured to eject the treatment liquid, and a second ejecting nozzle group as a line of nozzles arranged in the sub-scanning direction and configured to eject the aqueous ink composition. The first ejecting nozzle group overlaps, at least in a portion, the second ejecting nozzle group when projected in the main scanning direction.

DESCRIPTION OF EXEMPLARY EMBODIMENTS

Figure 1:
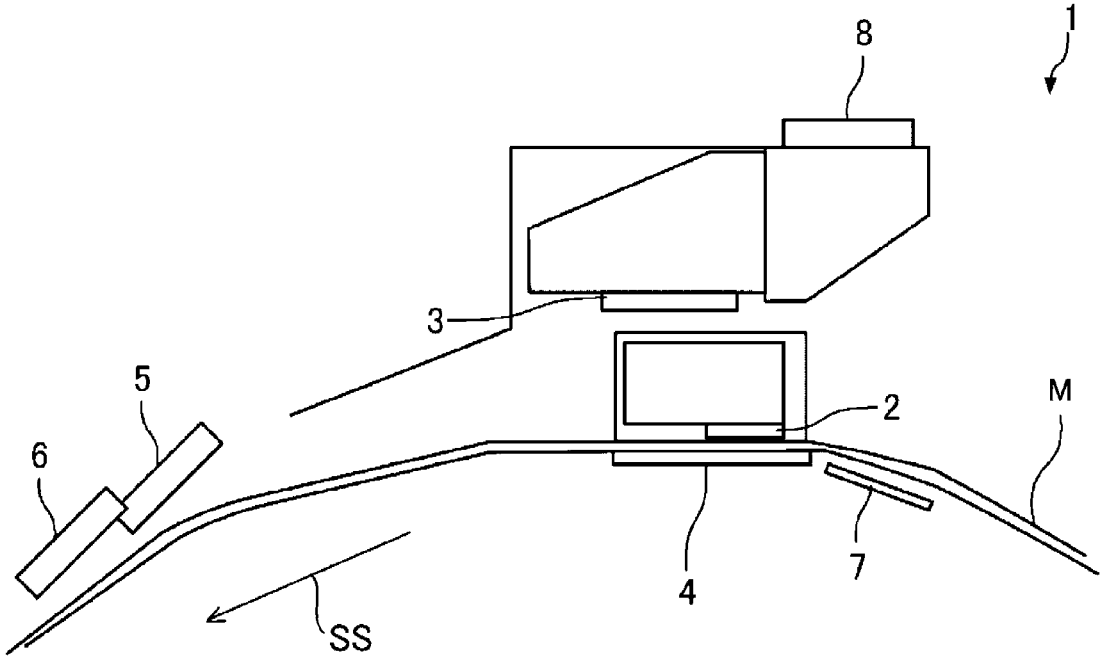
FIG. 1 is an outline illustration of an example of an ink jet recording apparatus for use in an ink jet recording method according to an embodiment.

The following describes embodiments of the present disclosure. The following embodiments are descriptions of examples of the disclosure. The disclosure is never limited to these embodiments and includes variations implemented within the gist of the disclosure. Not all the configurations described below are essential for the disclosure.

1. Ink Jet Recording Method

An ink jet recording method according to this embodiment includes a treatment liquid attachment step, in which a treatment liquid containing at least one flocculant is attached to a recording medium, and an ink attachment step, in which an aqueous ink composition is attached to the recording medium.

1.1. Recording Medium

The recording medium on which an image is formed in the ink jet recording method according to this embodiment may have a recording surface that absorbs liquids, such as aqueous ink compositions and treatment liquids, or may have no recording surface that absorbs liquids. The recording medium can therefore be of any type, including liquid-absorbing recording media, such as paper and cloths, low-liquid-absorbing recording media, such as paper for actual printing, and non-liquid-absorbing recording media, such as metals, glass, films, and polymers. The great advantages of the ink jet recording method according to this embodiment, however, become more significant when an image is recorded on a low- or non-liquid-absorbing recording medium.

A low- or non-liquid-absorbing recording medium is a recording medium that has the quality of absorbing little or no liquid. In quantitative terms, a non- or low-liquid-absorbing recording medium is a "recording medium that absorbs 10 $mL/m^2$ or less water from the start of contact until 30 $msec^{1/2}$ in the Bristow test." The Bristow test is the most widespread method for brief measurement of liquid absorption and has also been adopted by Japan Technical Association of the Pulp and Paper Industry (JAPAN TAPPI). The details of the test method are set forth in No. 51 of "JAPAN TAPPI Test Method 2000," which specifies the Bristow test as a method for testing the absorption of liquid in paper and paperboards. A liquid-absorbing recording medium, on the other hand, is a recording medium that is not non- or low-liquid-absorbing. Being low- and non-liquid-absorbing may be simply referred herein to as low-absorbent and non-absorbent, respectively.

Examples of non-liquid-absorbing recording media include a plastic film or plate, such as of polyvinyl chloride, polyethylene, polypropylene, or polyethylene terephthalate (PET), a metal plate, such as of iron, silver, copper, or aluminum, a metal plate produced by the deposition of any such metal, a plastic film, and an alloy plate, such as of stainless steel or brass. Recording media such as paper or any other base material coated with plastic, paper or any other base material with a plastic film bonded thereto, and a plastic film having no absorbing layer (receiving layer) are also examples. The plastic can be, for example, polyvinyl chloride, polyethylene terephthalate, polycarbonate, polystyrene, polyurethane, polyethylene, or polypropylene.

An example of a low-liquid-absorbing recording medium is a recording medium that has a coating layer for receiving liquids (receiving layer) on its surface. An example of one that includes paper as the base material is paper for actual printing, and examples of ones that include a plastic film as the base material include films of polyvinyl chloride, polyethylene terephthalate, polycarbonate, polystyrene, polyurethane, polyethylene, polypropylene, etc., having a coated surface, for example coated with a hydrophilic polymer, or having a surface coated with particles, for example of silica or titanium, and a binder.

A liquid-absorbing recording medium can be of any type, but examples range from printing paper with high permeability to liquids, such as electrophotographic paper, and ink jet paper (dedicated paper for ink jetting, which has an ink-absorbing layer formed by silica or alumina particles or an ink-absorbing layer formed by a hydrophilic polymer, such as polyvinyl alcohol (PVA) or polyvinyl pyrrolidone (PVP)) to paper that has relatively low permeability to liquids and is used in general offset printing, such as art paper, coated paper, and cast-coated paper. Fabrics and nonwovens are also examples of liquid-absorbing recording media.

The recording medium may be, for example, colorless and transparent, translucent, colored and transparent, chromatically colored and opaque, or achromatically colored and opaque. The recording medium may be colored and/or translucent or transparent in itself.

1.2. Treatment Liquid Attachment Step

The ink jet recording method according to this embodiment includes a treatment liquid attachment step. In the treatment liquid attachment step, a treatment liquid containing a flocculant is attached to the recording medium.

1.2.1. Treatment Liquid

The treatment liquid used in the ink jet recording method according to this embodiment contains a flocculant. The flocculant flocculates a subset or all of the substances, such as a colorant and resin particles, contained in the aqueous ink composition used in the ink attachment step.

1.2.1.1. Flocculant

The flocculant reacts with substances, such as a colorant and resin particles, contained in the aqueous ink composition, thereby causing the colorant and the resin particles to aggregate. The flocculation helps in, for example, improving the color strength of the colorant, improving the fixation of the image, and/or increasing the viscosity of the aqueous ink composition.

The flocculant can be of any kind, but examples include metal salts, acids, and miscellaneous cationic compounds.

Miscellaneous cationic compounds that can be used include cationic resins (sometimes called cationic polymers), cationic surfactants, etc.

An acid can be an inorganic or organic acid.

For metal salts, polyvalent metal salts are preferred. For miscellaneous cationic compounds, cationic resins are preferred. For acids, organic acids are preferred.

Preferably, the flocculant is any one of a cationic resin, an organic acid, and a metal salt because this makes the image superb, for example in quality, abrasion resistance, and gloss. It is more preferred that the flocculant be any one of a cationic resin, an organic acid, and a polyvalent metal salt. A combination of multiple flocculants can also be used.

A metal salt is preferably a polyvalent metal salt, but metal salts that are not polyvalent can also be used. Of these flocculants, it is particularly preferred to use at least one selected from metal salts and organic acids. They are superior in reactivity with substances contained in the ink.

A polyvalent metal salt is a compound formed by a metal ion with a valency of two or more and an anion. Examples of metal ions with a valency of two or more include the ions of calcium, magnesium, copper, nickel, zinc, barium, aluminum, titanium, strontium, chromium, cobalt, and iron. Of these metal ions that form a polyvalent metal salt, it is particularly preferred to use at least one of the calcium ion and the magnesium ion. These metal ions are superior in flocculating components of the ink.

The anion in a polyvalent metal salt is an inorganic or organic ion. That is, a polyvalent metal salt in this embodiment is formed by an inorganic or organic ion and a polyvalent metal. The inorganic ion can be the chloride, bromide, iodide, nitrate, sulfate, or hydroxide ion. The organic ion can be an organic acid ion, such as the carboxylate ion.

Preferably, the polyvalent metal compound is an ionic polyvalent metal salt. In particular, a magnesium or calcium salt gives the treatment liquid better stability. The counterion for the polyvalent metal may be an inorganic acid or organic acid ion.

Specific examples of polyvalent metal salts include calcium carbonates, such as heavy calcium carbonate and light calcium carbonate, calcium nitrate, calcium chloride, calcium sulfate, magnesium sulfate, calcium hydroxide, magnesium chloride, magnesium carbonate, barium sulfate, barium chloride, zinc carbonate, zinc sulfide, aluminum silicate, calcium silicate, magnesium silicate, copper nitrate, calcium acetate, magnesium acetate, and aluminum acetate. One of these polyvalent metal salts may be used alone, or two or more may be used in combination. Of these, it is particularly preferred to use at least one of magnesium sulfate, calcium nitrate, and calcium chloride, more preferably calcium nitrate. These salts help ensure sufficient solubility in water, and they also reduce marking caused by the treatment liquid (make marks less noticeable). The metal salts listed may have water of hydration in their raw-material form.

Examples of metal salts that are not polyvalent include monovalent metal salts, such as sodium salts and potassium salts. To name a few, sodium sulfate and potassium sulfate are examples of such metal salts.

Examples of preferred organic acids include poly(meth) acrylic acid, acetic acid, glycolic acid, malonic acid, malic acid, maleic acid, ascorbic acid, succinic acid, glutaric acid, fumaric acid, citric acid, tartaric acid, lactic acid, sulfonic acid, orthophosphoric acid, pyrrolidonecarboxylic acid, pyronecarboxylic acid, pyrrolecarboxylic acid, furancarboxylic acid, pyridinecarboxylic acid, coumarinic acid, thiophenecarboxylic acid, nicotinic acid, derivatives of these compounds, and salts thereof. One organic acid may be used alone, or two or more may be used in combination. Of salts of acids, those that are metal salts are categorized as the aforementioned metal salts.

Examples of preferred inorganic acids include sulfuric acid, hydrochloric acid, nitric acid, and phosphoric acid. One inorganic acid may be used alone, or two or more may be used in combination.

Examples of cationic resins (cationic polymers) include cationic urethane resins, cationic olefin resins, cationic amine resins, and cationic surfactants. Water-soluble cationic polymers are preferred.

A cationic urethane resin can be a commercially available one. Examples include HYDRAN CP-7010, CP-7020, CP-7030, CP-7040, CP-7050, CP-7060, and CP-7610 (trade names, Dainippon Ink and Chemicals, Inc.), SUPERFLEX 600, 610, 620, 630, 640, and 650 (trade names, DKS Co. Ltd.), and WBR-2120C and WBR-2122C urethane emulsions (trade names, Taisei Fine Chemical Co., Ltd.).

A cationic olefin resin is a resin that has an olefin, such as ethylene or propylene, as its structural backbone and can be a suitable one selected from known cationic olefin resins. The cationic olefin resin may be in emulsion form, in which the resin has been dispersed in a solvent, such as water or an organic solvent. The cationic olefin resin can be a commercially available one. Examples include ARROWBASE CB-1200 and CD-1200 (trade names, Unitika Ltd.).

A cationic amine resin only needs to have an amino group in its structure and can be a suitable one selected from known cationic amine resins. Examples include polyamine resins, polyamide resins, and polyallylamine resins. A polyamine resin is a resin that has an amino group in its resin backbone. A polyamide resin is a resin that has an amide group in its resin backbone. A polyallylamine resin is a resin that has an allyl-derived structure in its resin backbone.

Examples of cationic polyamine resins include Senka Corporation UNISENCE KHE103L (hexamethylenediamine/epichlorohydrin resin; pH of a 1% aqueous solution, approximately 5.0; viscosity, 20 to 50 (mPa·s); a 50% by mass solids aqueous solution) and UNISENCE KHE104L (dimethylamine/epichlorohydrin resin; pH of a 1% aqueous solution, approximately 7.0; viscosity, 1 to 10 (mPa·s); a 20% by mass solids aqueous solution). Further specific examples of commercially available cationic polyamine resins include FL-14 (SNF), ARAFIX 100, 251S, 255, and 255LOX (Arakawa Chemical), DK-6810, 6853, and 6885 and WS-4010, 4011, 4020, 4024, 4027, and 4030 (Seiko PMC), PAPYOGEN P-105 (Senka), Sumirez Resin 650(30), 675A, 6615, and SLX-1 (Taoka Chemical), Catiomaster® PD-1, 7, 30, A, PDT-2, PE-10, PE-30, DT-EH, EPA-SK01, and TMHMDA-E (Yokkaichi Chemical), and JETFIX 36N, 38A, and 5052 (Satoda Chemical Industrial).

Examples of polyallylamine resins include polyallylamine hydrochloride, polyallylamine amidosulfate, allylamine hydrochloride-diallylamine hydrochloride copolymers, allylamine acetate-diallylamine acetate copolymers, allylamine acetate-diallylamine acetate copolymers, allylamine hydrochloride-dimethylallylamine hydrochloride copolymers, allylamine-dimethylallylamine copolymers, polydiallylamine hydrochloride, polymethyldiallylamine hydrochloride, polymethyldiallylamine amidosulfate, polymethyldiallylamine acetate, polydiallyldimethylammonium chloride, diallylamine acetate-sulfur dioxide copolymers, diallylmethylethylammonium ethyl sulfite-sulfur dioxide copolymers, methyldiallylamine hydrochloride-sulfur dioxide copolymers, diallyldimethylammonium chloride-sulfur dioxide copolymers, and diallyldimethylammonium chloride-acrylamide copolymers.

Examples of cationic surfactants include primary, secondary, and tertiary amine salt compounds, alkylamine salts, dialkylamine salts, aliphatic amine salts, benzalkonium salts, quaternary ammonium salts, quaternary alkylammonium salts, alkylpyridinium salts, sulfonium salts, phosphonium salts, onium salts, and imidazolinium salts. Specific examples include hydrochlorides, acetates, and similar salts of laurylamine, coconut amine, and rosin amine and lauryltrimethylammonium chloride, cetyltrimethylammonium chloride, benzyltributylammonium chloride, benzalkonium chlorides, dimethylethyllaurylammonium ethyl sulfate, dimethylethyloctylammonium ethyl sulfate, trimethyllaurylammonium hydrochloride, cetylpyridinium chloride, cetylpyridinium bromide, dihydroxyethyllaurylamine, decyldimethylbenzylammonium chloride, dodecyldimethylbenzylammonium chloride, tetradecyldimethylammonium chloride, hexadecyldimethylammonium chloride, and octadecyldimethylammonium chloride.

Of these flocculants, the use of one or two or more selected from polyvalent metal salts, cationic polymers, and organic acids helps form an image of higher quality by virtue of their better flocculating effect. The use of cationic polymer(s) is more preferred. Cationic polymers are generally unlikely to crystallize, and, therefore, the use of one or more of them further reduces white haze.

The total flocculant content of the treatment liquid is not critical, but can be 0.1% by mass or more and 20.0% by mass or less, preferably 0.5% by mass or more and 15.0% by mass or less, more preferably 1.0% by mass or more and 10.0% by mass or less, even more preferably 2.0% by mass or more and 10.0% by mass or less.

A flocculant content of 4.0% by mass or more of the total mass of the treatment liquid is markedly effective in preventing bleed, but on the other hand tends to result more often in the separation, crystallization, etc., of the flocculant(s) when the treatment liquid dries. In the ink jet recording method according to this embodiment, white haze is reduced even with such a flocculant content. That is, situations in which the flocculant content is in any of the above ranges, in particular 4.0% by mass or more of the total mass of the treatment liquid, are preferred because they benefit more from the advantages of the ink jet recording method according to this embodiment. A flocculant content of 20% by mass or less is preferred in that the advantage of reduced white haze is especially great.

1.2.1.2. Extra Ingredients

Besides the flocculant, the treatment liquid may contain ingredients such as water, an organic solvent, a surfactant, resin particles, wax, an excipient, a preservative/antimold, an antirust, a chelating agent, a viscosity modifier, an antioxidant, and a fungicide unless its functions are impaired. The extra ingredients described in this section can also be used in the aqueous ink composition (described below). The description in this section therefore includes different preferences for selection, percentage, etc.

1.2.1.2. (1) Water

The treatment liquid and aqueous ink composition used in the ink jet recording method according to this embodiment may contain water. The treatment liquid and the aqueous ink composition are preferably water-based. A water-based composition contains water as a major solvent component. The water may be contained as the primary solvent component and is a component that evaporates away upon drying. Preferably, the water is of a type from which ionic impurities have been removed to the lowest possible levels, such as ion exchange water, ultrafiltered water, reverse osmosis water, distilled water, or any other type of purified water or ultrapure water. The use of sterilized water, for example sterilized by ultraviolet irradiation or adding hydrogen peroxide, is preferred because it helps control the development of molds and bacteria when the treatment liquid and/or the aqueous ink composition is/are stored long. The water content is preferably 45% by mass or more, more preferably 50% by mass or more and 98% by mass or less, even more preferably 55% by mass or more and 95% by mass or less of the total mass of the treatment liquid or aqueous ink composition.

1.2.1.2. (2) Organic Solvent

The treatment liquid and aqueous ink composition used in the ink jet recording method according to this embodiment may contain an organic solvent. Preferably, the organic solvent is water-soluble. Examples of functions of the organic solvent include to improve the wettability of the treatment liquid or aqueous ink composition on the recording medium and to enhance the water retention of the treatment liquid or aqueous ink composition. Examples of organic solvents include esters, alkylene glycol ethers, cyclic esters, nitrogen-containing solvents, and polyhydric alcohols. Examples of nitrogen-containing solvents include cyclic amides and acyclic amides. Examples of acyclic amides include alkoxyalkylamides.

An organic solvent contained in the treatment liquid and/or the aqueous ink composition preferably has a normal boiling point of 280.0° C. or less, preferably 160.0° C. or more and 270.0° C. or less, more preferably 180.0° C. or more and 260.0° C. or less, even more preferably 200.0° C. or more and 250.0° C. or less. Such an organic solvent is preferred in that it helps reduce white haze and that it provides better characteristics, such as abrasion resistance and ejection stability.

Examples of esters include glycol monoacetates, such as ethylene glycol monomethyl ether acetate, ethylene glycol monoethyl ether acetate, ethylene glycol monobutyl ether acetate, diethylene glycol monomethyl ether acetate, diethylene glycol monoethyl ether acetate, diethylene glycol monobutyl ether acetate, propylene glycol monomethyl ether acetate, dipropylene glycol monomethyl ether acetate, and methoxybutyl acetate, and glycol diesters, such as ethylene glycol diacetate, diethylene glycol diacetate, propylene glycol diacetate, dipropylene glycol diacetate, ethylene glycol acetate propionate, ethylene glycol acetate butyrate, diethylene glycol acetate butyrate, diethylene glycol acetate propionate, diethylene glycol acetate butyrate, propylene glycol acetate propionate, propylene glycol acetate butyrate, dipropylene glycol acetate butyrate, and dipropylene glycol acetate propionate.

An alkylene glycol ether can be any monoether or diether of an alkylene glycol, preferably an alkyl ether. Specific examples include alkylene glycol monoalkyl ethers, such as ethylene glycol monomethyl ether, ethylene glycol monoethyl ether, ethylene glycol monoisopropyl ether, ethylene glycol monobutyl ether, diethylene glycol monomethyl ether, diethylene glycol monoethyl ether, diethylene glycol monobutyl ether, triethylene glycol monomethyl ether, triethylene glycol monoethyl ether, triethylene glycol monobutyl ether, tetraethylene glycol monomethyl ether, tetraethylene glycol monoethyl ether, tetraethylene glycol monobutyl ether, propylene glycol monomethyl ether, propylene glycol monoethyl ether, propylene glycol monopropyl ether, propylene glycol monobutyl ether, dipropylene glycol monomethyl ether, dipropylene glycol monoethyl ether, dipropylene glycol monopropyl ether, dipropylene glycol monobutyl ether, and tripropylene glycol monobutyl ether, and alkylene glycol dialkyl ethers, such as ethylene glycol dimethyl ether, ethylene glycol diethyl ether, ethylene glycol dibutyl ether, diethylene glycol dimethyl ether, diethylene glycol diethyl ether, diethylene glycol dibutyl ether, diethylene glycol methyl ethyl ether, diethylene glycol methyl butyl ether, triethylene glycol dimethyl ether, triethylene glycol diethyl ether, triethylene glycol dibutyl ether, triethylene glycol methyl butyl ether, tetraethylene glycol dimethyl ether, tetraethylene glycol diethyl ether, tetraethylene glycol dibutyl ether, propylene glycol dimethyl ether, propylene glycol diethyl ether, dipropylene glycol dimethyl ether, dipropylene glycol diethyl ether, and tripropylene glycol dimethyl ether.

Of these alkylene glycol ethers, diethers are preferred to monoethers. The abrasion resistance of the resulting image tends to be better with diethers because diethers tend to be more effective in dissolving any resin particles in the treatment liquid or aqueous ink composition or making the resin particles swell.

Examples of cyclic esters include cyclic esters (lactones) such as β-propiolactone, γ-butyrolactone, δ-valerolactone, ε-caprolactone, β-butyrolactone, β-valerolactone, γ-valerolactone, β-hexanolactone, γ-hexanolactone, δ-hexanolactone, β-heptanolactone, γ-heptanolactone, δ-heptanolactone, ε-heptanolactone, γ-octanolactone, δ-octanolactone, ε-octanolactone, δ-nonalactone, ε-nonalactone, and ε-decanolactone and compounds resulting from the substitution of hydrogen(s) of the methylene group next to the carbonyl group of these lactones with a C1 to C4 alkyl group.

Examples of alkoxyalkylamides include 3-methoxy-N,N-dimethylpropionamide, 3-methoxy-N,N-diethylpropionamide, 3-methoxy-N,N-methylethylpropionamide, 3-ethoxy-N,N-dimethylpropionamide, 3-ethoxy-N,N-diethylpropionamide, 3-ethoxy-N,N-methylethylpropionamide, 3-n-butoxy-N,N-dimethylpropionamide, 3-n-butoxy-N,N-diethylpropionamide, 3-n-butoxy-N,N-methylethylpropionamide, 3-n-propoxy-N,N-dimethylpropionamide, 3-n-propoxy-N,N-diethylpropionamide, 3-n-propoxy-N,N-methylethylpropionamide, 3-isopropoxy-N,N-dimethylpropionamide, 3-isopropoxy-N,N-diethylpropionamide, 3-isopropoxy-N,N-methylethylpropionamide, 3-tert-butoxy-N,N-dimethylpropionamide, 3-tert-butoxy-N,N-diethylpropionamide, and 3-tert-butoxy-N,N-methylethylpropionamide.

Examples of cyclic amides include lactams, such as pyrrolidones including 2-pyrrolidone, 1-methyl-2-pyrrolidone, 1-ethyl-2-pyrrolidone, 1-propyl-2-pyrrolidone, and 1-butyl-2-pyrrolidone. These are preferred in that they promote the dissolution of the flocculant and help resin particles as described below form a coating. 2-Pyrrolidone is particularly preferred.

It is also preferred to use a compound represented by general formula (1). This compound is an alkoxyalkylamide, a type of acyclic amide.

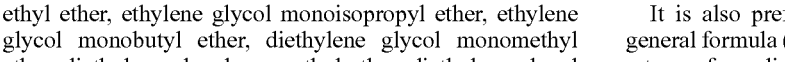

$$R^1—O—CH_2CH_2—(C=O)—NR^2R^3 \quad (1)$$

In formula (1), $R^1$ denotes a C1 to C4 alkyl group, and $R^2$ and $R^3$ each independently denote a methyl or ethyl group. The "C1 to C4 alkyl group" can be linear or branched.

To name a few, it can be a methyl, ethyl, n-propyl, isopropyl, n-butyl, sec-butyl, isobutyl, or tert-butyl group. One of those compounds represented by formula (1) may be used alone, or two or more may be used as a mixture.

An example of a function of the compound represented by formula (1) is to enhance the surface-drying characteristics and fixation of the treatment liquid and/or aqueous ink composition when attached to a low-absorbent recording medium. In particular, those compounds represented by formula (1) are highly effective in softening/dissolving vinyl chloride resins moderately. The compound represented by formula (1) therefore softens/dissolves the recording surface of a recording medium containing a vinyl chloride resin, thereby helping the treatment liquid or aqueous ink composition penetrate into the recording medium. The penetration of the treatment liquid or aqueous ink composition into the recording medium provides firm fixation of the ink and makes the surface of the ink easier to dry. The resulting image is therefore likely to be superior in surface-drying characteristics and fixation.

More preferably, $R^1$ in formula (1) is a methyl group, a C1 alkyl group. Those compounds of formula (1) having a methyl group in $R^1$ have low normal boiling points compared with those having a C2 to C4 alkyl group in $R^1$. The use of a compound of formula (1) having a methyl group in $R^1$ can therefore further improve the surface drying characteristics of the area of the recording medium to which the treatment liquid or aqueous ink composition is attached.

When an acyclic amide is used, its percentage is not critical but typically is 5% by mass or more and 50% by mass or less, preferably 8% by mass or more and 48% by mass or less of the total mass of the treatment liquid or aqueous ink composition. Such an acyclic amide content can further improve the fixation and surface-drying characteristics of the image. It is also preferred, for the same reasons, that the percentage of those compounds represented by formula (1) above, among other acyclic amides, be in any of the above ranges.

In the treatment liquid and/or aqueous ink composition, the percentage of nitrogen-containing solvents, to the total mass of the treatment liquid or aqueous ink composition, is preferably 1% by mass or more or 40% by mass or less, more preferably 2% by mass or more and 30% by mass or less, even more preferably 3% by mass or more and 25% by mass or less, still more preferably 5% by mass or more and 23% by mass or less, further preferably 7% by mass or more and 20% by mass or less, in particular 11% by mass or more and 20% by mass or less. This makes the resulting image better in, for example, abrasion resistance.

Examples of polyhydric alcohols includes 1,2-alkanediols (e.g., alkanediols such as ethylene glycol, propylene glycol (also known as propane-1,2-diol), 1,2-butanediol, 1,2-pentanediol, 1,2-hexanediol, 1,2-heptanediol, and 1,2-octanediol) and polyhydric alcohols other than 1,2-alkanediols (polyols) (e.g., diethylene glycol, dipropylene glycol, 1,3-propanediol, 1,3-butanediol (also known as 1,3-butylene glycol), 1,4-butanediol, 1,5-pentanediol, 1,6-hexanediol, 2-ethyl-2-methyl-1,3-propanediol, 2-methyl-2-propyl-1,3-propanediol, 2-methyl-1,3-propanediol, 2,2-dimethyl-1,3-propanediol, 3-methyl-1,3-butanediol, 2-ethyl-1,3-hexanediol, 3-methyl-1,5-pentanediol, 2-methylpentane-2,4-diol, trimethylolpropane, and glycerol).

Polyhydric alcohols can be divided into alkanediols and polyols. An alkanediol is a diol of a C5 or longer alkane. The number of carbon atoms in the alkane is preferably from 5 to 15, more preferably from 6 to 10, even more preferably from 6 to 8. A 1,2-alkanediol is preferred.

A polyol is a polyol of a C4 or shorter alkane or a condensate resulting from intermolecular condensation between hydroxy groups of polyols of a C4 or shorter alkane. The number of carbon atoms in the alkane(s) is preferably 2 or 3. The number of hydroxy groups in the molecule of the polyol is 2 or more, preferably 5 or less, more preferably 3 or less. When the polyol is the aforementioned condensate, the number of intermolecular condensations is 2 or more, preferably 4 or less, more preferably 3 or less. One polyhydric alcohol may be used alone, or two or more may be used as a mixture.

Alkanediols and polyols can function primarily as penetration solvents and/or moisturizing solvents. Alkanediols, however, tend to behave more as penetration solvents, and polyols tend to behave more as moisturizing solvents.

In the treatment liquid and/or aqueous ink composition, the percentage of organic solvents other than nitrogen-containing solvents, to the total mass of the treatment liquid or ink, is preferably 1.0% by mass or more and 40.0% by mass or less, more preferably 5.0% by mass or more and 30.0% by mass or less, even more preferably 10.0% by mass or more and 20.0% by mass or less.

When the treatment liquid and/or aqueous ink composition contains an organic solvent, it/they may contain one organic solvent alone or may contain two or more in combination.

When an organic solvent is used in the treatment liquid and/or aqueous ink composition, the total percentage of organic solvents to the total mass of the treatment liquid or aqueous ink composition can be 5% by mass or more. However, it is preferred that the percentage be 15% by mass or more, more preferably 25% by mass or more, even more preferably 30% by mass or more. This helps further reduce white haze by slowing down the drying of and film formation by the treatment liquid, limiting the separation of the flocculant, and making it more likely that the flocculant forms small crystals even when it crystalizes.

When an organic solvent is used in the treatment liquid and/or ink, the total percentage of organic solvents to the total mass of the treatment liquid or ink is preferably 50% by mass or less for the upper limit. It is, however, preferred that the percentage be 45% by mass or less, more preferably 40% by mass or less, so that the drying of the treatment liquid will not be too slow and therefore that the recording will quickly become ready for use.

In the treatment liquid and aqueous ink composition, the percentage, to the total mass, of organic solvent polyols that are liquid at 25° C. and have a normal boiling point of 280.0° C. or more is preferably 5.0% by mass or less. The percentage is more preferably 3.0% by mass or less, even more preferably 1.0% by mass or less, in particular 0.5% by mass or less, further preferably 0.3% by mass or less. As for the lower limit, the percentage is 0% by mass or more. That is, the treatment liquid and aqueous ink composition may be free of such polyols.

This helps improve the adhesion of the ink to the recording medium by ensuring good drying characteristics of the treatment liquid and aqueous ink composition attached to the recording medium. More preferably, the percentage, to the total mass of the treatment liquid or aqueous ink composition, of those organic solvents that are liquid at 25° C. and have a normal boiling point exceeding 280.0° C., whether polyols or not, is in any of the above ranges. Examples of organic solvents having a normal boiling point exceeding 280.0° C. include glycerol and polyethylene glycol monomethyl ether.

As stated, white haze is masked when the organic solvent content of the treatment liquid is high. A possible mechanism behind this is that since the treatment liquid is rich in solvent(s) in which its crystallizable component is insoluble, the nucleation upon water evaporation is scattered, rather than concentrating, on the surface of the recording medium, and the crystal nuclei are therefore less likely to grow large than with a low organic solvent content. Even after a metal salt separates out on the surface of the image, moreover, some of the organic solvent(s) as a component of the treatment liquid remains therearound. The residual organic solvent soaks into the crystals, reducing the difference in refractive index. As a result, the inventor presumes, the scattering of light is reduced on the matter that has separated out on the surface of the image, and the white haze becomes less visible.

1.2.1.2. (3) Surfactant

The treatment liquid and the aqueous ink composition may contain a surfactant. A function of the surfactant is to improve the wettability of the treatment liquid or aqueous ink composition on the recording medium or a substrate by reducing the surface tension of the liquid or composition. Among surfactants, acetylene glycol surfactants, silicone surfactants, and fluorosurfactants are particularly preferred for use.

An acetylene glycol surfactant can be of any kind, but examples include Surfynol 104, 104E, 104H, 104A, 104BC, 104DPM, 104PA, 104PG-50, 104S, 420, 440, 465, 485, SE, SE-F, 504, 61, DF37, CT111, CT121, CT131, CT136, TG, GA, and DF110D (all are trade names; Air Products and Chemicals), OLFINE B, Y, β, A, STG, SPC, E1004, E1010, PD-001, PD-002W, PD-003, PD-004, EXP. 4001, EXP. 4036, EXP. 4051, AF-103, AF-104, AK-02, SK-14, and AE-3 (all are trade names; Nissin Chemical Industry), and ACETYLENOL E00, E00β, E40, and E100 (all are trade names; Kawaken Fine Chemicals).

A silicone surfactant can be of any kind, but an example of a preferred one is a polysiloxane compound. The polysiloxane compound can be of any kind, but an example is a polyether-modified organosiloxane. Examples of commercially available polyether-modified organosiloxanes include BYK-306, BYK-307, BYK-333, BYK-341, BYK-345, BYK-346, and BYK-348 (all are trade names; BYK Japan) and KF-351A, KF-352A, KF-353, KF-354L, KF-355A, KF-615A, KF-945, KF-640, KF-642, KF-643, KF-6020, X-22-4515, KF-6011, KF-6012, KF-6015, and KF-6017 (all are trade names; Shin-Etsu Chemical).

A fluorosurfactant is preferably a fluorine-modified polymer. Specific examples include BYK-3440 (BYK Japan), SURFLON S-241, S-242, and S-243 (AGC Seimi Chemical), and FTERGENT 215M (NEOS).

When the treatment liquid or aqueous ink composition contains a surfactant, it may contain multiple surfactants. The surfactant content of the treatment liquid or aqueous ink composition is preferably 0.1% by mass or more and 2.0% by mass or less, more preferably 0.2% by mass or more and 1.5% by mass or less, even more preferably 0.3% by mass or more and 1.0% by mass or less of the total mass.

1.2.1.2. (4) Excipient

The treatment liquid and the aqueous ink composition may contain a urea, amine, saccharide, or similar substance as an excipient. Examples of ureas include urea, ethylene urea, tetramethylurea, thiourea, 1,3-dimethyl-2-imidazolidinone and similar compounds and betaines (e.g., trimethylglycine, triethylglycine, tripropylglycine, triisopropylglycine, N,N,N-trimethylalanine, N,N,N-triethylalanine, N,N,N-triisopropylalanine, N,N,N-trimethylmethylalanine, carnitine, and acetylcarnitine).

Examples of amines include diethanolamine, triethanolamine, and triisopropanolamine. The urea or amine may also function as a pH modifier.

Examples of saccharides include glucose, mannose, fructose, ribose, xylose, arabinose, galactose, aldonic acid, glucitol (sorbitol), maltose, cellobiose, lactose, sucrose, trehalose, and maltotriose.

1.2.1.2. (5) Others

The treatment liquid and the aqueous ink composition used in the ink jet recording method according to this embodiment may optionally contain ingredients such as resin particles, a preservative/antimold, an antirust, a chelating agent, a viscosity modifier, an antioxidant, and a fungicide.

1.2.2. Rigid-Body Pendulum Characteristics Test

The treatment liquid used in the ink jet recording method according to this embodiment is such that when it is tested using a rigid-body pendulum characteristics tester at 35.0° C. for 20.0 minutes, the minimum oscillation period of the rigid-body pendulum is 70.0% or more of the maximum oscillation period of the rigid-body pendulum.

When a treatment liquid dries, characteristics of the treatment liquid change. Many phenomena, including the drying, thickening, and solidification of the treatment liquid and the separation of solutes, occur and interact over time, changing the characteristics of the treatment liquid. These phenomena are difficult to examine separately, and even if it were possible to monitor some of them closely, the overall characteristics of the treatment liquid would remain unclear because of the involvement of the other phenomena.

In this embodiment, the treatment liquid is characterized using the rigid-body pendulum characteristics test, a test specified in ISO 12013-1 and 12013-2. The rigid-body pendulum characteristics test evaluates the general, or macroscopic, characteristics of the treatment liquid, rather than characterizing the individual phenomena, such as the drying, thickening, and solidification of the treatment liquid and the separation of solutes. Examples of data that can be obtained in the rigid-body pendulum characteristics test include the logarithmic attenuation of the pendulum's amplitude and the time course of the pendulum's oscillation period. An example of an ISO 12013-1- and 12013-2-compliant instrument for the rigid-body pendulum characteristics test is "A&D Co., Ltd." "RPT-3000W" rigid-body pendulum characteristics tester.

After extensive research, the inventor found that when the rigid-body pendulum characteristics test is performed under particular conditions, the pendulum's oscillation period provides a sensitive measure of the characteristics of the treatment liquid used in the ink jet recording method according to this embodiment. The time course of the pendulum's oscillation period, moreover, is well correlated with the white haze on the surface of images produced using the treatment liquid. The relevance to white haze is stronger for the time course of the pendulum's oscillation period than for the formula of the treatment liquid, such as the chemical makeup of the treatment liquid and the concentration of each ingredient. To describe the relationship between the pendulum's oscillation period and crystallization, the inventor speculates that the behavior of the solidification resulting from crystal growth is reflected in the rigid-body pendulum's period.

When water in a treatment liquid evaporates as a result of warming, the solids there are concentrated and crystallize. The speeds of nucleation and crystal growth depend on the type and amount of the solvent and flocculant contained. Once the crystals of the treatment liquid grow large and separate out, the white haze is seriously aggravated. The transformation from the liquid to the crystalline (solid) state, moreover, causes a change in the pendulum's oscillation period. This seems to be the reason why the time course of the pendulum's oscillation period is associated with the behavior of white haze.

Specifically, the rigid-body pendulum characteristics test in this embodiment is performed using "RPT-3000W." With the rigid-body frame being "FRB-100 (A&D)," the measuring section's shape being "RBP060," two, three, or four spacers, whichever is appropriate, on the frame, and the angle of swing set to 0.40 degrees, changes in the free oscillations of the pendulum are measured. The test specimen is a 20.0-μm-thick coating of the treatment liquid spread on a glass plate (e.g., a coverslip for optical microscopes), and immediately after the measuring section of the pendulum is placed on it, the measurement is started under ordinary temperature and normal humidity conditions (22.0° C. or more and 25.0° C. or less, preferably 22.0° C. or more and 24.0° C. or less, and 35.0% RH or more and 60.0% RH or less, preferably 40.0% RH or more and 55.0% RH or less). The temperature setting for the sample stage is 35.0° C., and the time of temperature elevation from the ordinary temperature to 35.0° C. is set to 1 minute.

An exemplary procedure for the measurement is as follows. That is, the pendulum is held at its maximum amplitude using an electromagnet for 2.0 seconds, and then the electric current to the electromagnet is turned off to let the pendulum swing freely. The displacement of the pendulum is monitored using a displacement sensor for 4.0 seconds of free oscillations. After 4.0 seconds passes, an electric current is distributed to the electromagnet to hold the pendulum at its maximum amplitude. Two seconds later, the electric current to the electromagnet is turned off to let the pendulum swing freely, and the displacement is measured for the next 4.0 seconds of free oscillations. This cycle of measurement, 6 seconds per cycle, is repeated. That is, ten cycles of measurement are performed per minute. The measurement is repeated for 20.0 minutes after the temperature reaches 35.0° C., providing data on changes in the pendulum's oscillation period over time.

The time dependence of the oscillation period obtained in such a way varies with the formula of the treatment liquid, but is more sensitive to the macroscopic behavior than to the formula of the treatment liquid. In the typical time course, the oscillation period is the greatest (longest) at the start of measurement and then gradually decreases (shortens) over the 20.0 minutes of measurement. Although the period may occasionally bounce back after reaching the minimum, the maximum period is usually observed at the start of measurement. The minimum period can be observed halfway during the 20.0 minutes of measurement or can be observed near the end of the 20.0 minutes of measurement.

The inventor found that ink jet recording using a treatment liquid produces an image with acceptably thin white haze when, in a test of the treatment liquid performed using a rigid-body pendulum characteristics tester at 35.0° C. for 20.0 minutes, the minimum oscillation period of the rigid-body pendulum is 70.0% or more of the maximum oscillation period of the rigid-body pendulum.

More preferably, the minimum oscillation period of the rigid-body pendulum with the treatment liquid is 75.0% or more, even more preferably 80.0% or more, of the maximum oscillation period of the rigid-body pendulum.

Overall, the treatment liquid used in the ink jet recording method according to this embodiment is a treatment liquid that contains a flocculant, and when it is tested using a rigid-body pendulum characteristics tester at 35.0° C. for 20.0 minutes, the minimum oscillation period of the rigid-body pendulum is 70.0% or more of the maximum oscillation period of the rigid-body pendulum. The treatment liquid used in the ink jet recording method according to this embodiment is suitable for use in an ink jet recording method that includes a treatment liquid attachment step and an ink attachment step.

1.2.3. Characteristics of the Treatment Liquid and Attachment to a Recording Medium The treatment liquid preferably has a surface tension at 25.0° C. of 40.0 mN/m or less, more preferably 38.0 mN/m or less, even more preferably 35.0 mN/m or less, still more preferably 30.0 mN/m or less. This ensures moderate wetting and spread on the recording medium.

In the ink jet recording method according to this embodiment, the treatment liquid is attached to the recording medium by an ink jet process. Thus, it is preferred that the viscosity of the treatment liquid at 20.0° C. be 1.5 mPa·s or more and 15.0 mPa·s or less, more preferably 1.5 mPa·s or more and 5.0 mPa·s or less, even more preferably 1.5 mPa·s or more and 3.6 mPa·s or less. By virtue of the use of an ink jet process to attach the treatment liquid to the recording medium, it is easy to coat a predetermined area of the recording medium with the treatment liquid efficiently. The details of the ink jet process are given below.

1.3. Ink Attachment Step

The ink jet recording method according to this embodiment includes an ink attachment step, in which an aqueous ink composition is attached to the recording medium.

1.3.1. Aqueous Ink Composition

The aqueous ink composition contains at least water and a colorant. The water is as described in "1.2.1.2.(1) Water" and is not discussed again.

1.3.1. (1) Colorant

The aqueous ink composition contains a colorant. The colorant can be a pigment or dye, and examples of colorants that can be used include inorganic pigments such as carbon black and titanium white, organic pigments, solvent dyes, acidic dyes, direct dyes, reactive dyes, basic dyes, disperse dyes, and sublimation dyes. In the ink in this embodiment, the colorant may be dispersed with a dispersing resin.

Examples of inorganic pigments that can be used include carbon black (C.I. Pigment Black 7) pigments, such as furnace black, lamp black, acetylene black, and channel black, iron oxide, titanium oxide, zinc oxide, and silica.

Examples of carbon black pigments include Mitsubishi Chemical Corporation's No. 2300, 900, MCF88, No. 20B, No. 33, No. 40, No. 45, No. 52, MA7, MA8, MA100, and No. 2200B. Other examples include Degussa's Color Black FW1, FW2, FW2V, FW18, FW200, S150, S160, and S170, Printex 35, U, V, and 140U, and Special Black 6, 5, 4A, 4, and 250, Columbian Carbon's Conductex SC and Raven 1255, 5750, 5250, 5000, 3500, 1255, and 700, and Cabot's REGAL 400R, 330R, and 660R, MOGUL L, MONARCH 700, 800, 880, 900, 1000, 1100, 1300, and 1400, and ELFTEX 12.

Examples of organic pigments include quinacridone pigments, quinacridone quinone pigments, dioxazine pigments, phthalocyanine pigments, anthrapyrimidine pigments, anthanthrone pigments, indanthrone pigments, flavanthrone pigments, perylene pigments, diketopyrrolopyrrole pigments, perinone pigments, quinophthalone pigments, anthraquinone pigments, thioindigo pigments, benzimidazolone pigments, isoindolinone pigments, azomethine pigments, and azo pigments.

Specific examples of organic pigments that can be used in the aqueous ink composition include the following.

For cyan pigments, examples include C.I. Pigment Blue pigments, such as C.I. Pigment Blue 1, 2, 3, 15:3, 15:4, 15:34, 16, 22, and 60; and C.I. Vat Blue pigments, such as C.I. Vat Blue 4 and 60. An example of a preferred cyan pigment is one or a mixture of two or more selected from the group consisting of C.I. Pigment Blue 15:3, 15:4, and 60.

For magenta pigments, examples include C.I. Pigment Red 5, 7, 12, 48 (Ca), 48 (Mn), 57 (Ca), 57:1, 112, 122, 123, 168, 184, and 202 and C.I. Pigment Violet 19. An example of a preferred magenta pigment is one or a mixture of two or more selected from the group consisting of C.I. Pigment Red 122, 202, and 209 and C.I. Pigment Violet 19.

For yellow pigments, examples include C.I. Pigment Yellow 1, 2, 3, 12, 13, 14C, 16, 17, 73, 74, 75, 83, 93, 95, 97, 98, 119, 110, 114, 128, 129, 138, 150, 151, 154, 155, 180, and 185. An example of a preferred yellow pigment is one or a mixture of two or more selected from the group consisting of C.I. Pigment Yellow 74, 109, 110, 128, and 138.

An orange pigment can be, for example, C.I. Pigment Orange 36 or 43 or a mixture of them. A pigment in a green ink can be, for example, C.I. Pigment Green 7 or 36 or a mixture of them.

These pigments listed by way of example are examples of preferred pigments and do not limit any aspect of the present disclosure. One of these pigments or a mixture of two or more may be used. These pigments, moreover, may be used in combination with dye(s).

The pigment may be dispersed before use with a dispersant selected from, for example, water-soluble resins, water-dispersible resins, and surfactants. Alternatively, the surface of the pigment may be oxidized or sulfonated, for example with ozone, hypochlorous acid, or fuming sulfuric acid, to make the pigment self-dispersible before use.

When a pigment in the ink in this embodiment is dispersed with a dispersing resin, the ratio between the pigment and the dispersing resin is preferably from 10:1 to 1:10, more preferably from 4:1 to 1:3. The dispersed pigment has a maximum particle diameter of less than 500 nm and a volume-average particle diameter of 300 nm or less as measured by dynamic light scattering. More preferably, the volume-average particle diameter is 200 nm or less.

Examples of dyes that can be used in the aqueous ink composition include water-soluble dyes, such as acidic dyes, direct dyes, reactive dyes, and basic dyes, and water-dispersible dyes, such as disperse dyes, solvent dyes, and sublimation dyes.

Examples of acidic dyes include C.I. Acid Yellow 17, 23, 42, 44, 79, and 142, C.I. Acid Red 52, 80, 82, 249, 254, and 289, C.I. Acid Blue 9, 45, and 249, and C.I. Acid Black 1, 2, 24, and 94.

Examples of direct dyes include C.I. Direct Yellow 1, 12, 24, 33, 50, 55, 58, 86, 132, 142, 144, and 173, C.I. Direct Red 1, 4, 9, 80, 81, 225, and 227, C.I. Direct Blue 1, 2, 15, 71, 86, 87, 98, 165, 199, and 202, C.I. Direct Black 19, 38, 51, 71, 154, 168, and 195, and C.I. Direct Blue 2, 3, 8, 10, 12, 31, 35, 63, 116, 130, 149, 199, 230, and 231.

Examples of reactive dyes include C.I. Reactive Yellow 2, 7, 15, 22, 37, 42, 57, 69, 76, 81, 95, 102, 125, and 135, C.I. Reactive Red 2, 14, 24, 32, 55, 79, 106, 111, and 124, C.I. Reactive Blue 2, 13, 21, 38, 41, 50, 69, 72, 109, 120, and 143, and C.I. Reactive Black 3, 4, 5, 8, 13, 14, 31, 34, 35, and 39.

Examples of basic dyes include C.I. Basic Yellow 1, 2, 13, 19, 21, 25, 32, 36, 40, and 51, C.I. Basic Red 1, 5, 12, 19, 22, 29, 37, 39, and 92, C.I. Basic Blue 1, 3, 9, 11, 16, 17, 24, 28, 41, 45, 54, 65, and 66, and C.I. Basic Black 2 and 8.

As for disperse dyes and solvent dyes, any colorant can be used that does not dissolve but disperses in the ink vehicle. Examples include azo dyes, metal complex azo dyes, anthraquinone dyes, phthalocyanine dyes, and triarylmethane dyes.

Examples of disperse dyes include C.I. Disperse Red 60, 82, 86, 86:1, 167:1, and 279, C.I. Disperse Yellow 64, 71, 86, 114, 153, 233, and 245, C.I. Disperse Blue 27, 60, 73, 77, 77:1, 87, 257, and 367, C.I. Disperse Violet 26, 33, 36, and 57, and C.I. Disperse Orange 30, 41, and 61.

Examples of solvent dyes include C.I. Solvent Yellow 16, 21, 25, 29, 33, 51, 56, 82, 88, 89, 150, and 163, C.I. Solvent Red 7, 8, 18, 24, 27, 49, 109, 122, 125, 127, 130, 132, 135, 218, 225, and 230, C.I. Solvent Blue 14, 25, 35, 38, 48, 67, 68, 70, and 132, and C.I. Solvent Black 3, 5, 7, 27, 28, 29, and 34.

A sublimation dye can be a disperse dye, solvent dye, or any other dye that has the nature mentioned above. Specific examples of such dyes include C.I. Disperse Yellow 3, 7, 8, 23, 39, 51, 54, 60, 71, and 86; C.I. Disperse Orange 1, 1:1, 5, 20, 25, 25:1, 33, 56, and 76; C.I. Disperse Brown 2; C.I. Disperse Red 11, 50, 53, 55, 55:1, 59, 60, 65, 70, 75, 93, 146, 158, 190, 190:1, 207, 239, and 240; C.I. Vat Red 41; C.I. Disperse Violet 8, 17, 23, 27, 28, 29, 36, and 57; C.I. Disperse Blue 19, 26, 26:1, 35, 55, 56, 58, 64, 64:1, 72, 72:1, 81, 81:1, 91, 95, 108, 131, 141, 145, and 359; and C.I. Solvent Blue 36, 63, 105, and 111. One of these may be used alone, or two or more may be used in combination.

The listed dyes are examples of preferred colorants and do not limit any aspect of the present disclosure. One of these dyes or a mixture of two or more may be used. These dyes, moreover, may be used in combination with pigment(s).

The colorant content can be adjusted to be appropriate for the intended purpose of use. Preferably, the colorant content is 0.10% by mass or more and 20.0% by mass or less, more preferably 0.20% by mass or more and 15.0% by mass or less, even more preferably 1.0% by mass or more and 10.0% by mass or less.

When the colorant is a pigment, the volume-average diameter of the pigment particles (before mixing with the treatment liquid) is preferably 10.0 nm or more and 200.0 nm or less, more preferably 30.0 nm or more and 200.0 nm or less, even more preferably 50.0 nm or more and 150.0 nm or less, in particular 70.0 nm or more and 120.0 nm or less.

When the aqueous ink composition contains carbon black or when the ink composition is a mixture of cyan, magenta, and yellow colorants to produce the color black, the color of the aqueous ink composition can be in the following range in the CIELAB color space: $|a^*| \leq 10.0$, $|b^*| \leq 10.0$, and $0 \leq L^* 50.0$. That is, the aqueous ink composition can be a black ink having a color in the range from gray to black.

The reduction of white haze provided by the ink jet recording method according to this embodiment becomes more significant when the aqueous ink composition is a black ink. With a black ink, any white haze on the produced image is more conspicuous than without it.

1.3.1. (2) Extra Ingredients

Besides the water and colorant, the aqueous ink composition may contain ingredients such as a dispersant, an organic solvent, a surfactant, resin particles, wax, an excipient, a preservative/antimold, an antirust, a chelating agent, a viscosity modifier, an antioxidant, and a fungicide unless its functions are impaired. Of these, the organic solvent, surfactant, excipient, preservative/antimold, antirust, chelating agent, viscosity modifier, antioxidant, fungicide, etc., are as described above for the treatment liquid and are not discussed again.

(1) Dispersant

The aqueous ink composition in this embodiment may contain a dispersant for water-insoluble substances, such as a pigment or disperse dye. A function of the dispersant is to disperse water-insoluble colorant(s) in the ink. The dispersant can be of any kind, but examples include anionic dispersants, nonionic dispersants, and polymer dispersants (also called resin dispersants, dispersing resins, etc.).

An example of a preferred anionic dispersant is a formalin condensate of an aromatic sulfonic acid. Examples of the "aromatic sulfonic acid" in the formalin condensate of an aromatic sulfonic acid include creosote oil sulfonic acid, cresol sulfonic acid, phenol sulfonic acid, β-naphthol sulfonic acid, alkylnaphthalene sulfonic acids, such as methylnaphthalene sulfonic acid and butylnaphthalene sulfonic acid, mixtures of β-naphthalene sulfonic acid and β-naphthol sulfonic acid, mixtures of cresol sulfonic acid and 2-naphthol-6-sulfonic acid, and lignin sulfonic acid and its salts.

Preferably, the anionic dispersant is a formalin condensate of β-naphthalene sulfonic acid, a formalin condensate of an alkylnaphthalene sulfonic acid, or a formalin condensate of creosote oil sulfonic acid or its salt, more preferably a sodium salt.

Examples of nonionic surfactants include ethylene oxide adducts of phytosterol and ethylene oxide adducts of cholestanol.

Of these, examples of commercially available naphthalene sulfonic acid dispersants include DEMOL NL (naphthalene sulfonic acid, Kao Corporation), DEMOL MS, DEMOL N, DEMOL RN, DEMOL RN-L, DEMOL SC-30, DEMOL SN-B, DEMOL SS-L, DEMOL T, and DEMOL T-45.

Examples of polymer dispersants (also called "resin dispersants") include water-soluble resins, such as (meth) acrylic resins and their salts, the resins including poly(meth) acrylic acid, (meth)acrylic acid-acrylonitrile copolymers, (meth)acrylic acid-(meth)acrylate copolymers, vinyl acetate-(meth)acrylate copolymers, vinyl acetate-(meth) acrylic acid copolymers, and vinylnaphthalene-(meth) acrylic acid copolymers; styrene resins and their salts, the resins including styrene-(meth)acrylic acid copolymers, styrene-(meth)acrylic acid copolymers, styrene-(meth)acrylic acid-(meth)acrylate copolymers, styrene-α-methylstyrene-(meth)acrylic acid copolymers, styrene-α-methylstyrene-(meth)acrylic acid-(meth)acrylate copolymers, styrene-maleic acid copolymers, and styrene-maleic anhydride copolymers; urethane resins and their salts, the urethane resins being polymeric compounds (resins) that contain urethane linkages resulting from the reaction between isocyanate groups and hydroxyl groups and may be linear and/or branched, with or without a crosslink structure; polyvinyl alcohols; vinylnaphthalene-maleic acid copolymers and their salts; vinyl acetate-maleate copolymers and their salts; and vinyl acetate-crotonic acid copolymers and their salts.

Examples of commercially available styrene-based resin dispersants include X-200, X-1, X-205, X-220, and X-228 (Seiko PMC), SN-DISPERSANT® 6100 and 6110 (San Nopco Ltd.), Joncryl 67, 586, 611, 678, 680, 682, and 819 (BASF), DISPERBYK-190 (BYK Japan K.K.), and N-EA137, N-EA157, N-EA167, N-EA177, N-EA197D, N-EA207D, and E-EN10 (DKS).

Examples of commercially available acrylic resin dispersants include BYK-187, BYK-190, BYK-191, BYK-194N, and BYK-199 (BYK) and Aron A-210, A6114, AS-1100, AS-1800, A-30SL, A-7250, and CL-2 (Toagosei Co., Ltd.).

Examples of commercially available urethane-based resin dispersants include BYK-182, BYK-183, BYK-184, and BYK-185 (BYK), TECO Disperse 710 (Evonik Tego Chemie), Borchi® Gen 1350 (OMG Borchers).

One dispersant may be used alone, or two or more may be used in combination. The total dispersant content is 0.1% by mass or more and 30% by mass or less, preferably 0.5% by mass or more and 25% by mass or less, more preferably 1% by mass or more and 20% by mass or less, even more preferably 1.5% by mass or more and 15% by mass or less, with the mass of the ink as 100%. A dispersant content of 0.1% by mass or more helps ensure the dispersion stability of the colorant. A dispersant content of 30% by mass or less ensures that the colorant is not dissolved excessively, and the viscosity is kept low.

Of these dispersants listed by way of example, it is particularly preferred the dispersant(s) be resin dispersant(s), in particular at least one selected from acrylic resins, styrene resins, and urethane resins. More preferably, the weight-average molecular weight of the dispersant(s) is 500 or more. Such resin dispersants are relatively odorless and help further improve the dispersion stability of the colorant.

(2) Resin Particles

The aqueous ink composition used in the recording method according to this embodiment may contain resin particles. The resin particles function as a fixing resin, or to improve the adhesion of the components of the aqueous ink composition attached to the recording medium. Such resin particles can be, for example, particles of a urethane resin, acrylic resin, styrene-acrylic resin, fluorene resin, polyolefin resin, rosin-modified resin, terpene resin, polyester resin, polyamide resin, epoxy resin, vinyl chloride resin, vinyl chloride-vinyl acetate copolymer, or ethylene vinyl acetate resin. These kinds of resin particles are usually handled in emulsion form, but may alternatively be powder. One kind of resin particles or a combination of two or more kinds may be used.

Urethane resin is a generic term for resins that have the urethane linkage. A urethane resin may be, for example, a polyether urethane resin, which contains, besides the urethane linkage, the ether linkage in its backbone, a polyester urethane resin, which contains the ester linkage in its backbone, or a polycarbonate urethane resin, which contains the carbonate linkage in its backbone. The urethane resin can be a commercially available one. For example, the urethane resin may be non-cohesive particles selected from commercially available urethane resins including SUPERFLEX 460, 460s, 840, and E-4000 (trade names, DKS Co., Ltd.), RESAMINE D-1060, D-2020, D-4080, D-4200, D-6300, and D-6455 (trade names, Dainichiseika Color & Chemicals Mfg.), Takelac WS-6021 and W-512-A-6 (trade names, Mitsui Chemicals Polyurethanes), Sancure 2710 (trade name, LUBRIZOL), and PERMARIN UA-150 (trade name, Sanyo Chemical Industries).

Acrylic resin is a generic term for polymers obtained by polymerizing at least an acrylic monomer, such as (meth) acrylic acid or a (meth)acrylate, as a component. Examples include resins obtained from an acrylic monomer and copolymers of an acrylic monomer and a different monomer. Examples include acryl-vinyl resins, which are copolymers of an acrylic monomer and a vinyl monomer. Copolymers with styrene or a similar vinyl monomer are another class of examples.

The acrylic monomer can alternatively be, for example, acrylamide or acrylonitrile. A resin emulsion made from an acrylic resin can be a commercially available one. For example, the resin emulsion may be a non-cohesive one selected from commercially available resin emulsions including FK-854 (trade name, Chuo Rika Kogyo), Mowinyl 952B and 718A (trade names, the Nippon Synthetic Chemical Industry), and Nipol LX852 and LX874 (trade names, Zeon).

An acrylic resin herein may be a styrene-acrylic resin. The expression (meth)acrylic herein refers to at least one of acrylic and methacrylic.

A styrene-acrylic resin is a copolymer of a styrene monomer and an acrylic monomer. Examples include styrene-acrylic acid copolymers, styrene-methacrylic acid copolymers, styrene-methacrylic acid-acrylate copolymers, styrene-α-methylstyrene-acrylic acid copolymers, and styrene-α-methylstyrene-acrylic acid-acrylate copolymers. The styrene-acrylic resin can be a commercially available one. For example, the styrene-acrylic resin may be non-cohesive particles selected from commercially available styrene-acrylic resins including Joncryl 62J, 7100, 390, 711, 511, 7001, 632, 741, 450, 840, 74J, HRC-1645J, 734, 852, 7600, 775, 537J, 1535, PDX-7630A, 352J, 352D, PDX-7145, 538J, 7640, 7641, 631, 790, 780, and 7610 (trade names, BASF), Mowinyl 966A and 975N (trade names, the Nippon Synthetic Chemical Industry), and VINYBLAN 2586 (Nissin Chemical Industry).

A polyolefin resin is a resin that has an olefin, such as ethylene, propylene, or butylene, as its structural backbone and can be a suitable one selected from known polyolefin resins. The olefin resin can be a commercially available one. For example, the olefin resin may be non-cohesive particles selected from commercially available olefin resins including ARROWBASE CB-1200 and CD-1200 (trade names, UNITIKA Ltd.).

The resin particles, moreover, may be supplied in emulsion form. Examples of a commercially available collection of such resin emulsions include MICROGEL E-1002 and E-5002 (trade names of Nippon Paint products, styrene-acrylic resin emulsions), VONCOAT 4001 (trade name of a DIC product, an acrylic resin emulsion), VONCOAT 5454 (trade name of a DIC product, a styrene-acrylic resin emulsion), POLYSOL AM-710, AM-920, AM-2300, AP-4735, AT-860, and PSASE-4210E (acrylic resin emulsions), POLYSOL AP-7020 (styrene-acrylic resin emulsion), POLYSOL SH-502 (vinyl acetate resin emulsion), POLYSOL AD-13, AD-2, AD-10, AD-96, AD-17, and AD-70 (ethylene-vinyl acetate resin emulsions), POLYSOL PSASE-6010 (ethylene-vinyl acetate resin emulsion) (trade names of Showa Denko products), POLYSOL SAE1014 (trade name, a styrene-acrylic resin emulsion, Zeon), SAIVINOL SK-200 (trade name, an acrylic resin emulsion, Saiden Chemical Industry), AE-120A (trade name of a JSR product, an acrylic resin emulsion), AE373D (trade name of an Emulsion Technology product, a carboxy-modified styrene-acrylic resin emulsion), SEIKADYNE 1900W (trade name of a Dainichiseika Color & Chemicals Mfg. product, an ethylene-vinyl acetate resin emulsion), VINYBLAN 2682 (acrylic resin emulsion), VINYBLAN 2886 (vinyl acetate-acrylic resin emulsion), VINYBLAN 5202 (acetic acid-acrylic resin emulsion) (trade names of Nissin Chemical Industry products), elitel KA-5071S, KT-8803, KT-9204, KT-8701, KT-8904, and KT-0507 (trade names of Unitika products, polyester resin emulsions), Hytec SN-2002 (trade name of a Toho Chemical product, a polyester resin emulsion), Takelac W-6020, W-635, W-6061, W-605, W-635, and W-6021 (trade names of Mitsui Chemicals Polyurethanes products, urethane resin emulsions), SUPERFLEX 870, 800, 150, 420, 460, 470, 610, and 700 (trade names of DKS products, urethane resin emulsions), PERMARIN UA-150 (Sanyo Chemical Industries, a urethane resin emulsion), Sancure 2710 (Lubrizol Japan, a urethane resin emulsion), NeoRez R-9660, R-9637, and R-940 (Kusumoto Chemicals Ltd., urethane resin emulsions), ADEKA BONTIGHTER HUX-380 and 290K (ADEKA Corporation, urethane resin emulsions), Mowinyl 966A and Mowinyl 7320 (the Nippon Synthetic Chemical Industry), Joncryl 7100, 390, 711, 511, 7001, 632, 741, 450, 840, 74J, HRC-1645J, 734, 852, 7600, 775, 537J, 1535, PDX-7630A, 352J, 352D, PDX-7145, 538J, 7640, 7641, 631, 790, 780, and 7610 (BASF), NK Binder R-5HN (Shin-Nakamura Chemical Co., Ltd.), HYDRAN WLS-210 (non-crosslinked polyurethane, DIC Corporation), and Joncryl 7610 (BASF), and the resin emulsion may be a non-cohesive one selected from such commercially available resin emulsions.

When the aqueous ink composition contains resin particles, their percentage is 0.1% by mass or more and 20% by mass or less, preferably 1% by mass or more and 15% by mass or less, more preferably 2% by mass or more and 10% by mass or less of the total mass of the ink on a solids basis.

(3) Wax

The aqueous ink composition may contain wax. Since the wax described in this section can be used in non-white inks, the description in this section includes different preferences for selection, percentage, etc. The presence of wax is also allowed in the treatment liquid, but preferably the treatment liquid is wax-free because wax can cause flocculation and/or thickening. With its function of giving lubricity to the ink image, the wax helps reduce, for example, the detachment of the ink image.

The wax can be, for example, a vegetable/animal wax, such as carnauba wax, candelilla wax, beeswax, rice bran wax, or lanolin; a petroleum wax, such as paraffin wax, microcrystalline wax, polyethylene wax, oxidized polyethylene wax, or petrolatum; a mineral wax, such as montan wax or ozokerite; or a synthetic wax, such as carbon wax, hoechst wax, a polyolefin wax, or a stearic acid amide, a natural/synthetic wax emulsion, such as an α-olefin-maleic anhydride copolymer, or a compound wax or a mixture of two or more such waxes. Of these, it is particularly preferred to use a polyolefin wax (in particular, polyethylene wax or polypropylene wax) and paraffin wax. They are more effective than others in improving fixation on a flexible packaging film.

It is also possible to use a commercially available wax as it is. Examples include NOPCOTE PEM-17 (trade name, San Nopco Ltd.), CHEMIPEARL W4005 (trade name, Mitsui Chemicals, Inc.), and AQUACER 515, 539, and 593 (trade names, BYK Japan K.K.).

When the ink jet recording method includes a heating step, excessive melting of the wax may affect its performance. It is therefore preferred that the melting point of the wax be 50.0° C. or more and 200.0° C. or less, more preferably 70.0° C. or more and 180.0° C. or less, even more preferably 90.0° C. or more and 150.0° C. or less.

The wax may be supplied in emulsion or suspension form. The wax content is 0.1% by mass or more and 10.0% by mass or less, preferably 0.5% by mass or more and 5.0% by mass or less, more preferably 0.5% by mass or more and 2.0% by mass or less of the total mass of the ink on a solids basis. The aforementioned function of the wax is highly effective when the wax content is in any of these ranges. It is enough that the wax is contained in one or both of the white and non-white inks for its function of giving lubricity to the image to be sufficiently effective.

1.3.2. Attachment of the Aqueous Ink Composition to the Recording Medium

The aqueous ink composition is attached to the recording medium by an ink jet process. Thus, it is preferred that the viscosity of the aqueous ink composition be 1.5 mPa·s or more and 15.0 mPa·s or less, more preferably 1.5 mPa·s or more and 7.0 mPa·s or less, even more preferably 1.5 mPa·s or more and 5.5 mPa·s or less at 20° C. By virtue of the use of an ink jet process to attach the aqueous ink composition to the recording medium, it is easy to form a predetermined image on the recording medium efficiently. The details of the ink jet process are given below.

The aqueous ink composition used in the ink jet recording method according to this embodiment preferably has a surface tension at 25.0° C. of 40.0 mN/m or less, more preferably 38.0 mN/m or less, even more preferably 35.0 mN/m or less, still more preferably 30.0 mN/m or less. This ensures moderate wetting and spread on the recording medium.

1.4. Other Steps

The ink jet recording method according to this embodiment includes attaching a treatment liquid and an aqueous ink composition to a recording medium. The method, however, may optionally further include attaching one or more of treatment liquids and aqueous ink compositions to the recording medium. Attachment of a liquid can be repeated as many times as appropriate, and the order is not critical either. The ink jet recording method according this embodiment, furthermore, may include, for example, a drying step, in which liquid(s) attached to the recording medium is/are dried, or heating the recording medium (postheating step).

1.4.1. Drying Step

The ink jet recording method according to this embodiment may include a drying step. The ink jet recording method according to this embodiment may include drying the recording medium before or during a treatment liquid or aqueous ink composition attachment step. Besides stopping recording and leaving the recording medium to dry, the drying step can be performed by drying the recording medium using a drying mechanism. Examples of drying mechanisms include blowing air at the ordinary temperature or warm air toward the recording medium (aeration drying), a component that comes into contact with and transfers heat to the recording medium (conduction drying), irradiating the recording medium with heat radiation (e.g., infrared radiation) (radiation drying), and a combination of two or more of these. When the recording method includes a drying step, it is particularly preferred that the drying step be performed by aeration drying.

The surface temperature of the recording medium when a treatment liquid or aqueous ink composition is attached thereto is preferably 45° C. or less, more preferably 20° C. or more and 45° C. or less. Preferably, the surface temperature is 27.0° C. or more and 45° C. or less, more preferably 28° C. or more and 43° C. or less, even more preferably 30° C. or more and 40° C. or less, in particular 32° C. or more and 38° C. or less. This temperature is the surface temperature of the portion of the recording surface of the recording medium to which the treatment liquid or ink is attached in its attachment step, and is the highest temperature the recording zone reaches during the attachment step. A surface temperature in any of these ranges is preferred in terms of image quality, abrasion resistance, the reduction of clogging, and high gloss.

A drying step can be performed simultaneously with one or two or more of treatment liquid attachment steps and ink attachment steps as described above. When a drying step is performed simultaneously with an ink attachment step, the surface temperature of the recording medium is preferably 43° C. or less, more preferably 40° C. or less.

1.4.2. Postheating Step

The ink jet recording method according to this embodiment may further include, after attachment steps as described above, a postheating step, in which the recording medium is heated. The postheating step can be performed using, for example, an appropriate heater. For example, the postheating step is performed using an afterheater. (In the example of an ink jet recording apparatus described below, the heating heater 5 corresponds to it.) The heater does not need to be a component of the ink jet recording apparatus but may be an external dryer. By ensuring that the resulting image dries to a fuller degree of fixation, this helps, for example, make the recording ready for use quickly.

The temperature of the recording medium in this case is not critical, but the glass transition temperature (Tg) of the resin component that forms the resin particles in the recording, for example, may be a factor to consider. When the Tg of the resin component that forms the resin particles or a resin component that forms wax is considered, it is good to set the temperature of the recording medium higher than the Tg of the resin component that forms the resin particles by 5.0° C. or more, preferably 10.0° C. or more.

The surface temperature to which the recording medium is heated in the postheating step is 30.0° C. or more and 120.0° C. or less, preferably 40.0° C. or more and 100.0° C. or less, more preferably 50.0° C. or more and 95° C. or less, even more preferably 70° C. or more and 90° C. or less. It is particularly preferred that the recording medium be heated to a surface temperature of 80° C. or more in the postheating step. A temperature of the recording medium substantially in these ranges helps the resin particles and any wax in the recording form a coating and spread flat, and also helps the resulting image dry to a fuller degree of fixation.

1.5. Ink Jet Recording Apparatus

The following describes, with reference to drawings, an example of an ink jet recording apparatus with which the ink jet recording method according to this embodiment is performed. The ink jet recording apparatus with which the ink jet recording method according to this embodiment is performed carries out the treatment liquid attachment step and the ink attachment step through multiple main scans, in which a recording head moves in a main scanning direction, and multiple sub-scans, in which the recording medium moves in a sub-scanning direction, which crosses the main scanning direction. The recording head has a first ejecting nozzle group, which includes a line of nozzles arranged in the sub-scanning direction and ejects a treatment liquid, and a second ejecting nozzle group, which includes a line of nozzles arranged in the sub-scanning direction and ejects an aqueous ink composition. The first and second ejecting nozzle groups overlap when projected in the main scanning direction.

Figure 2:
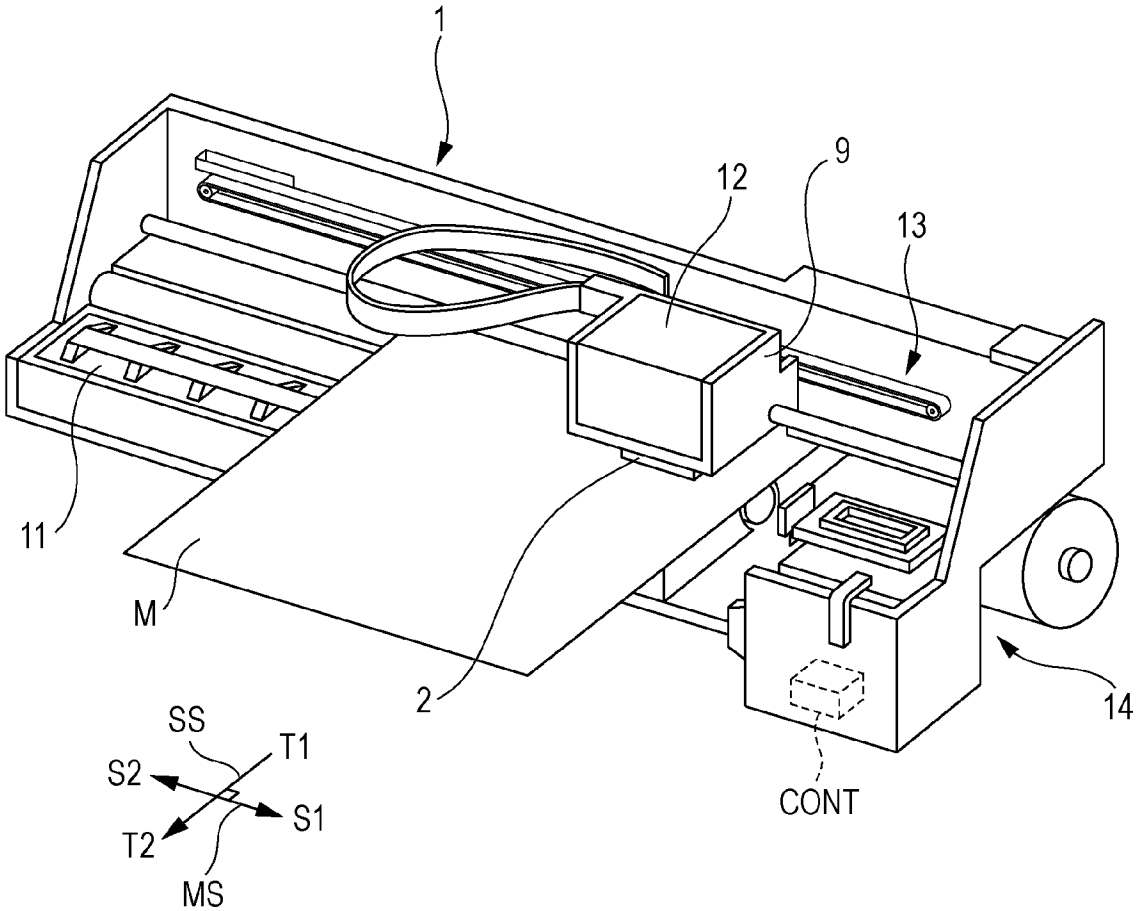
FIG. 2 is an outline illustration of a carriage and its surroundings in an example of an ink jet recording apparatus for use in an ink jet recording method according to an embodiment.

FIG. 1 is an outline cross-sectional diagram schematically illustrating the ink jet recording apparatus. FIG. 2 is a perspective view of a carriage and its surroundings in their exemplary configuration in the ink jet recording apparatus 1 illustrated in FIG. 1. As illustrated in FIGS. 1 and 2, the ink jet recording apparatus 1 has a recording head 2, an IR heater 3, a platen heater 4, a heating heater 5, a cooling fan 6, a preheater 7, an aeration fan 8, a carriage 9, a platen 11, a carriage-moving mechanism 13, a transporter 14, and a control section CONT. The control section CONT, illustrated in FIG. 2, controls the overall operation of the ink jet recording apparatus 1.

The recording head 2 produces a recording on a recording medium M by ejecting an ink and a treatment liquid from nozzles of the recording head 2 and attaching them to the recording medium M. In this embodiment, the recording head 2 is a serial recording head. It therefore attaches the ink and treatment liquid to the recording medium M by making multiple scans relative to the recording medium M in a main scanning direction. The recording head 2 is on the carriage 9, illustrated in FIG. 2. What drives the scans of the recording head 2 relative to the recording medium M in the main scanning direction is the operation of the carriage-moving mechanism 13, which moves the carriage 9 in the direction of medium width, or along the width of the recording medium M. The direction of medium width is the main scanning direction, or the direction in which the recording head 2 scans. A scan in the main scanning direction is also referred to as a main scan.

The main scanning direction is also the direction in which the carriage 9 moves with the recording head 2 thereon. In FIG. 1, the main scanning direction is the direction that crosses the direction of transport of the recording medium M, or a sub-scanning direction, indicated by the arrow SS. In FIG. 2, the direction along the width of the recording medium M, i.e., the direction S1-S2, is the main scanning direction MS, and the direction represented by T1→T2 is the sub-scanning direction SS. One scan is a one-way scan in the main scanning direction, i.e., in the direction of arrow S1 or S2. A main scan, of the recording head 2, and a sub-scan, which is the transport of the recording medium M, are repeated to produce a recording on the recording medium M. That is, the treatment liquid attachment step and the ink attachment step are performed through multiple main scans, in which a recording head 2 moves in a main scanning direction, and multiple sub-scans, in which the recording medium M moves in a sub-scanning direction, which crosses the main scanning direction.

The cartridge 12, which supplies the ink and treatment liquid to the recording head 2, includes multiple independent cartridges. The cartridge 12 has been detachably attached to the carriage 9 carrying the recording head 2 thereon. Each of the multiple cartridges are filled with a different aqueous ink composition or treatment liquid, and the cartridge 12 supplies an aqueous ink composition and a treatment liquid to the corresponding nozzles. Although the cartridge 12 in this embodiment is on the carriage 9, this is not the only possible configuration. The cartridge 12 may be somewhere other than the carriage 9, and the liquid supply to the nozzles may be achieved through supply piping not illustrated.

Any known technology can be used to make the recording head 2 perform its ejection task. In this embodiment, vibrations of piezoelectric elements are used to eject droplets. That is, mechanical deformation of electrostrictive elements is used to form ink droplets.

The ink jet recording apparatus 1 has an IR heater 3 and a platen heater 4, both for heating the recording medium M during the ejection of the aqueous ink composition and/or treatment liquid from the recording head 2. When a drying step is performed to dry the recording medium M in this embodiment, the IR heater 3 and the undermentioned aeration fan 8, for example, can be used.

By using the IR heater 3, the recording medium M can be heated from the recording head 2 side with radiant infrared heat, or by radiation heating. It often heats the recording head 2, too, but with less influence of the thickness of the recording medium M than with heating from the back of the recording medium M, for example with the platen heater 4. The ink jet recording apparatus 1 may include a fan that dries the ink and/or treatment liquid on the recording medium M by blowing warm air or air at the surrounding temperature to the recording medium M (e.g., the aeration fan 8).

The platen heater 4 is positioned opposite the recording head 2 and is capable of heating the recording medium M there with a platen 11 therebetween to ensure that the treatment liquid and/or aqueous ink composition ejected from the recording head 2 can be dried early after being attached to the recording medium M. The platen heater 4 is capable of conduction heating of the recording medium M, and the ink jet recording method according to this embodiment can be performed with or without using it. When used, the platen heater 4 is preferably controlled to make the surface temperature of the recording medium M 40.0° C. or less.

The surface temperature to which the recording medium M is heated by the IR heater 3 and the platen heater 4 is preferably, for the upper limit, 45.0° C. or less, more preferably 40.0° C. or less, even more preferably 38.0° C. or less, in particular 35.0° C. or less. As for the lower limit, the surface temperature of the recording medium M is preferably 25.0° C. or more, more preferably 28.0° C. or more, even more preferably 30.0° C. or more, in particular 32.0° C. or more. This helps limit the drying and chemical alteration of the aqueous ink compositions and treatment liquids in the recording head 2, thereby helping prevent the deposition of the aqueous ink compositions and resins on the inner walls of the recording head 2. Such a surface temperature of the recording medium M also encourages early fixation of the aqueous ink composition and/or treatment liquid on the recording medium, thereby helping improve image quality.

The heating heater 5 is a heater that dries and solidifies the aqueous ink composition attached to the recording medium M, i.e., a heater for secondary heating or secondary drying. The heating heater 5 can be used in a postheating step. The heating heater 5 heats the recording medium M with a recorded image thereon. As a result, the water, for example, in the aqueous ink composition evaporates away quickly, leaving an ink film formed by the resin contained in the aqueous ink composition. The heating heater 5 therefore makes the ink jet recording apparatus 1 superior in film formation by ensuring that an ink film becomes firmly fixed on or adheres firmly to the recording medium M, thereby helping produce a good and high-quality image in a short time. The surface temperature to which the recording medium M is heated by the heating heater 5 is preferably, for the upper limit, 120.0° C. or less, more preferably 100.0° C. or less, even more preferably 90.0° C. or less. As for the lower limit, the surface temperature of the recording medium M is preferably 60.0° C. or more, more preferably 70.0° C. or more, even more preferably 80.0° C. or more. A surface temperature in any of these ranges helps produce a high-quality image in a short time. This surface temperature of the recording medium M in secondary heating, or the surface temperature to which the recording medium M is heated in a postheating step, is referred to as the secondary heating temperature or curing temperature.

The ink jet recording apparatus 1 may have a cooling fan 6. By drying the aqueous ink composition attached to the recording medium M and then cooling the ink on the recording medium M with the recording fan 6, a highly adhesive ink coating can be formed on the recording medium M.

The ink jet recording apparatus 1, moreover, may include a preheater 7 that heats the recording medium M in advance of the attachment of the aqueous ink composition to the recording medium M. Furthermore, the ink jet recording apparatus 1 may include an aeration fan 8 so that the aqueous ink composition and/or treatment liquid attached to the recording medium M can be dried more efficiently.

Under the carriage 9 are a platen 11 that supports the recording medium M, a carriage-moving mechanism 13 that moves the carriage 9 relative to the recording medium M, and a transporter 14 that is rollers that transport the recording medium M in the sub-scanning direction. The operation of the carriage-moving mechanism 13 and that of the transporter 14 are controlled by the control section CONT.

Figure 3:
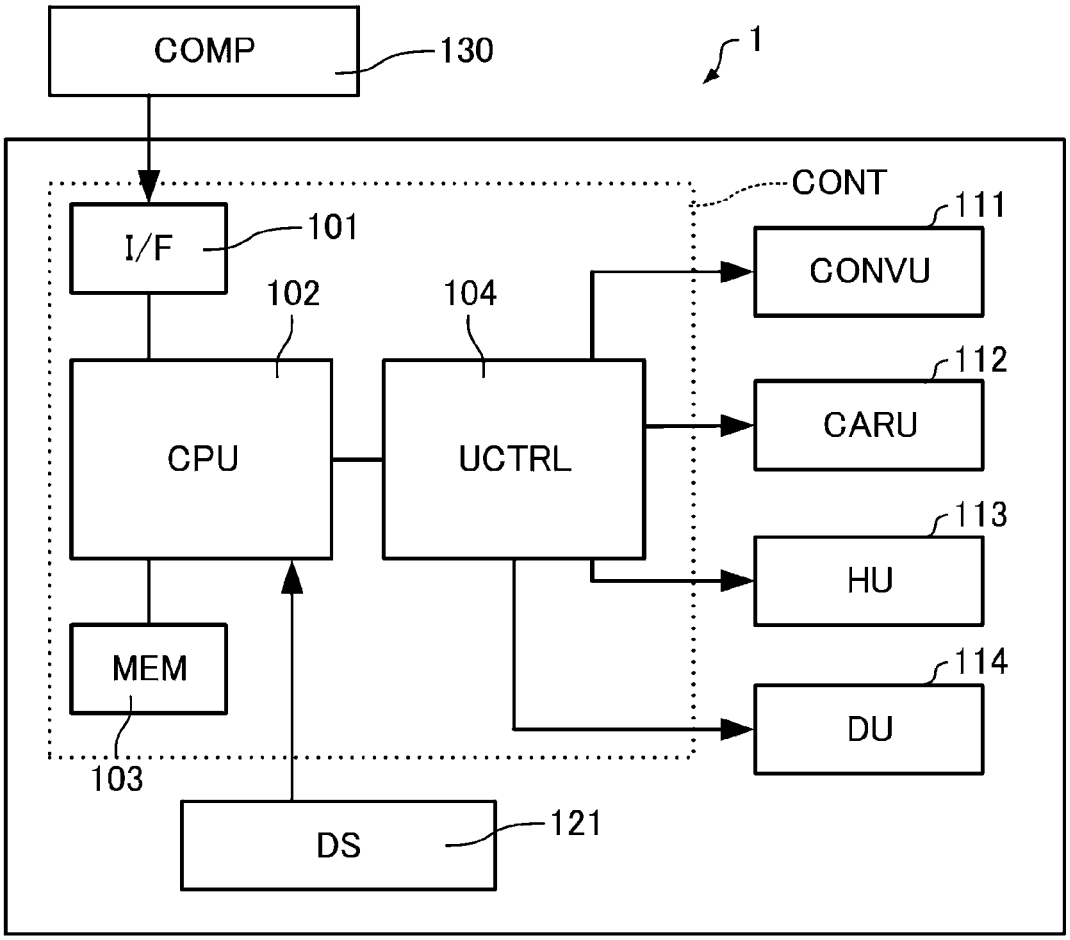
FIG. 3 is a block diagram for an example of an ink jet recording apparatus for use in an ink jet recording method according to an embodiment.

FIG. 3 is a functional block diagram for the ink jet recording apparatus 1. The control section CONT is a control unit for controlling the ink jet recording apparatus 1. The interface 101 (I/F) is for exchanging data between a computer 130 (COMP) and the ink jet recording apparatus 1. The CPU 102 is a processing unit for controlling the entire ink jet recording apparatus 1. The memory 103 (MEM) is for, for example, storing programs and providing workspace for the CPU 102. The CPU 102 controls each unit via a unit control circuit 104 (UCTRL). The internal status of the ink jet recording apparatus 1 is monitored by a set of detectors 121 (DS), and the control section CONT controls each unit based on detected events.

The transport unit 111 (CONVU) controls sub-scans (transport) in ink jet recording, specifically the rate and direction of transport of the recording medium M. Specifically, the transport unit 111 controls the rate and direction of transport of the recording medium M by controlling the rate and direction of rotation of motor-driven transport rollers.

The carriage unit 112 (CARU) controls main scans (passes) in ink jet recording, or specifically moves the recording head 2 back and forth in the main scanning direction. The carriage unit 112 includes a carriage 9 for the recording head 2 and a carriage-moving mechanism 13 for moving the carriage 9 back and forth.

The head unit 113 (HU) controls the volume of treatment liquid or aqueous ink composition ejected from nozzles of the recording head 2. For example, when the nozzles of the recording head 2 are ones that are driven by piezoelectric elements, the head unit 113 controls the operation of the piezoelectric element for each nozzle. The parameters controlled by the head unit 113 include the timing of the attachment of each droplet of and the dot size of the aqueous ink composition or treatment liquid. The carriage unit 112 and the head unit 113, moreover, together control the amount(s) of treatment liquid and/or aqueous ink composition attached per scan.

The drying unit 114 (DU) controls the temperature of heaters, such as the IR heater 3, preheater 7, platen heater 4, and heating heater 5.

The ink jet recording apparatus 1 alternates the operation of moving the carriage 9, with the recording head 2 thereon, in the main scanning direction and the transport operation (sub-scans). During each pass, the control section CONT controls the carriage unit 112 to make it move the recording head 2 in the main scanning direction, and also controls the head unit 113 to make the recording head 2 eject droplets of the treatment liquid and/or aqueous ink composition from predetermined nozzle holes and attach the droplets of the treatment liquid and/or aqueous ink composition to the recording medium M. During the transport operation, moreover, the control section CONT controls the transport unit 111 to make it transport the recording medium M in the direction of transport by a predetermined distance (feed).

As the ink jet recording apparatus 1 repeats a main scan (pass) and a sub-scan (transport), the recording zone is transported little by little with attached multiple droplets thereon. The droplets attached to the recording medium M are then dried using an afterheater 5, finishing the image. The finished recording may then be rolled by a rolling mechanism or transported on a flatbed mechanism.

The following describes the arrangement of lines of nozzles on the nozzle face of the recording head 2 of an ink jet recording apparatus used in the ink jet recording method according to this embodiment. In an exemplary arrangement, the recording head 2 has a first ejecting nozzle group, which includes a line of nozzles arranged in the sub-scanning direction and ejects a treatment liquid, and a second ejecting nozzle group, which includes a line of nozzles arranged in the sub-scanning direction and ejects an aqueous ink composition, and the first and second ejecting nozzle groups overlap when projected in the main scanning direction.

Figure 4:
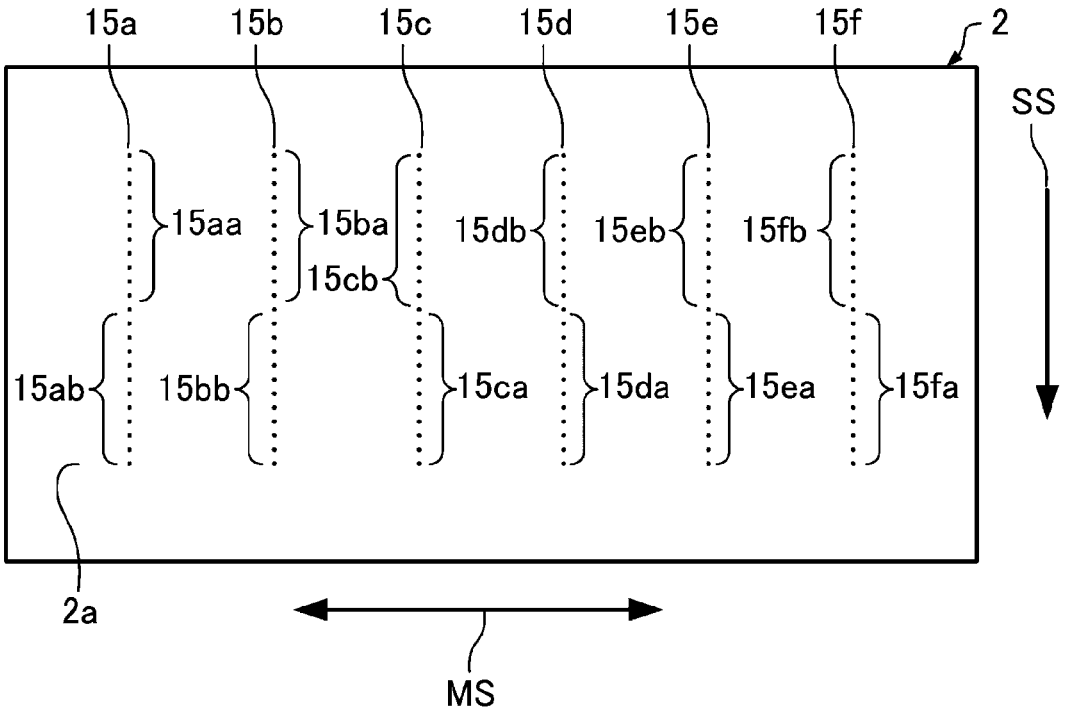
FIG. 4 is a schematic plan view of an example of a nozzle face of a recording head of an ink jet recording apparatus for use in an ink jet recording method according to an embodiment.

FIG. 4 schematically illustrates an example of an arrangement of nozzle lines on the nozzle face 2*a* of a recording head 2. The recording head 2 has a nozzle face 2*a*, a surface with multiple nozzles therein. In the example illustrated in FIG. 4, the nozzle face 2*a* of the recording head 2 has multiple nozzle lines 15*a*, 15*b*, 15*c*, 15*d*, 15*e*, and 15*f* each formed by multiple nozzles arranged in the sub-scanning direction SS. There may be more nozzle lines. In FIG. 4, MS denotes the main scanning direction.

When the ink jet recording method according to this embodiment is performed using a recording head 2 that has nozzle lines arranged as illustrated by way of example in FIG. 4, the recording head 2 can be used with, for example, the nozzle line 15*a* loaded with a treatment liquid and the nozzle lines 15*b* to 15*f* loaded with aqueous ink compositions in different colors. The number of nozzle lines and the order of the inks, for example, loaded are not critical and can be customized as appropriate.

In the illustrated example, the nozzle lines 15*a* to 15*f* are in the same position in the sub-scanning direction SS. The nozzle lines 15*a* to 15*f* only need to be partially in the same position in the sub-scanning direction SS. In other words, the nozzle lines 15*a* to 15*f* overlap when projected in the main scanning direction MS.

The recording head 2 can be controlled to use a subset of nozzles, in each nozzle line, in its recording job. That is, a selection can be made so that each nozzle line has a group of ejecting nozzles and a group of non-ejecting nozzles. In an exemplary configuration, such a selection can be made by the user by inputting his/her selection to the control section CONT. Alternatively, the ink jet recording apparatus 1 may have a stored preset menu, for example stored in the memory 103, from which the user can choose the assignment of ejecting and non-ejecting nozzles in each nozzle line. An assembly of nozzles used for recording in a nozzle line is hereinafter referred to as an ejecting nozzle group, and an assembly of nozzles not used for recording in a nozzle line is referred to as a non-ejecting nozzle group. An ejecting nozzle group is an assembly of those nozzles selected to be used for recording and assigned a duty to eject a liquid in a recording job and includes any such nozzle even if it goes wrong during the recording job due to an unintended problem. A non-ejecting nozzle group is an assembly of those nozzles not selected to be used for recording and not assigned a duty to eject a liquid during a recording job and includes any such nozzle even if it ejects a liquid for any purpose other than image formation, such as for maintenance purposes.

In the example in FIG. 4, a possible configuration is that in the treatment liquid nozzle line 15*a*, the nozzle subsets 15*aa* and 15*ab* are used for recording as ejecting nozzle groups. In the aqueous ink composition nozzle lines 15*b* to 15*f*, the nozzle subsets 15*ba* to 15*fa* (second ejecting nozzle groups) and the nozzle subsets 15*bb* to 15*fb* are used for recording as ejecting nozzle groups. This configuration allows the recording head 2 to fire the aqueous ink compositions and treatment liquid concurrently.

When two or more ejecting nozzle groups in different nozzle lines overlap when projected in the main scanning direction MS, the liquids ejected from the nozzle lines adhere to the same area of the recording medium in one main scan (pass). Such a form of attachment is referred to as concurrent firing.

The concurrent firing in this case not only refers to ejecting two or more liquids exactly at the same time but also encompasses ejecting two or more liquids onto the same recording area in one main scan. For example, a main scan may be an operation in which a recording head ejects a treatment liquid and an aqueous ink composition while moving in the main scanning direction.

Moreover, an ejecting nozzle group located upstream in the sub-scanning direction SS, or the direction of transport of the recording medium M, attaches the liquid it ejects to the recording medium M in advance of any ejecting nozzle group located downstream. For example, when there is an ejecting nozzle group upstream in the direction of transport of the recording medium, or in the sub-scanning direction, in the ink jet recording method according to this embodiment, this ejecting nozzle group attaches the ink, for example, it ejects to the recording medium M in advance of any ejecting nozzle group located downstream.

In the example illustrated in FIG. 4, an alternative configuration is that in the treatment liquid nozzle line 15*a*, the nozzle subset 15*aa*, upstream in the sub-scanning direction, is used for recording as an ejecting nozzle group, whereas the nozzle subset 15*ab*, downstream in the sub-scanning direction, is not used for recording and therefore is a non-ejecting nozzle group. In the aqueous ink composition nozzle lines 15*b* to 15*f*, the nozzle subsets 15*ba* and 15*cb* to 15*fb* are not used for recording and therefore are non-ejecting nozzle groups, whereas the nozzle subsets 15*bb* and

15*ca* to 15*fa* are used for recording as ejecting nozzle groups. This configuration allows the recording head 2 to fire the treatment liquid in advance of the aqueous ink compositions.

Since the ejecting nozzle group for the treatment liquid is upstream, in the sub-scanning direction SS, of those for the ink compositions, the treatment liquid adheres in an earlier main scan than the ink compositions to the same area of the recording medium M.

Although not illustrated, another configuration is possible in which the treatment liquid nozzle line 15*a* only has the nozzles 15*aa*, the ink composition nozzle lines 15*b* to 15*f* only have the nozzles 15*bb* and 15*ca* to 15*fa*, and these are all nozzles in the nozzle lines. In this case, the advance firing of the treatment liquid can be achieved without assigning a non-ejecting nozzle group in each nozzle line.

When a first ejecting nozzle group, which ejects a treatment liquid, and a second ejecting nozzle group, which ejects an ink composition, overlap when projected in the main scanning direction, the first, or treatment liquid-, ejecting nozzle group only needs to partially overlap the second, or ink composition-, ejecting nozzle group.

Preferably, the first, or treatment liquid-, ejecting nozzle group overlaps the second, or ink composition-, ejecting nozzle group over 50% or more, more preferably 70% or more, even more preferably 90% or more of its length in the sub-scanning direction. The same applies to the second, or ink composition-, ejecting nozzle group. This is preferred in that this helps reduce the overall length of the recording apparatus in the sub-scanning direction or increase the recording speed. With such an overlap, this embodiment is particularly advantageous in that it provides excellent ejection stability despite the increased recording speed.

Any nozzle line can have an ejecting nozzle group in any position independently of the other nozzle lines, not limited to the example illustrated in FIG. 4. The overlap between nozzle lines when projected in the main scanning direction MS may be designed, for example to reduce the number of non-ejecting nozzle groups. The length and number of ejecting nozzle groups and those of non-ejecting nozzle groups in a nozzle line, moreover, can be customized as appropriate for each nozzle group.

Figure 5:
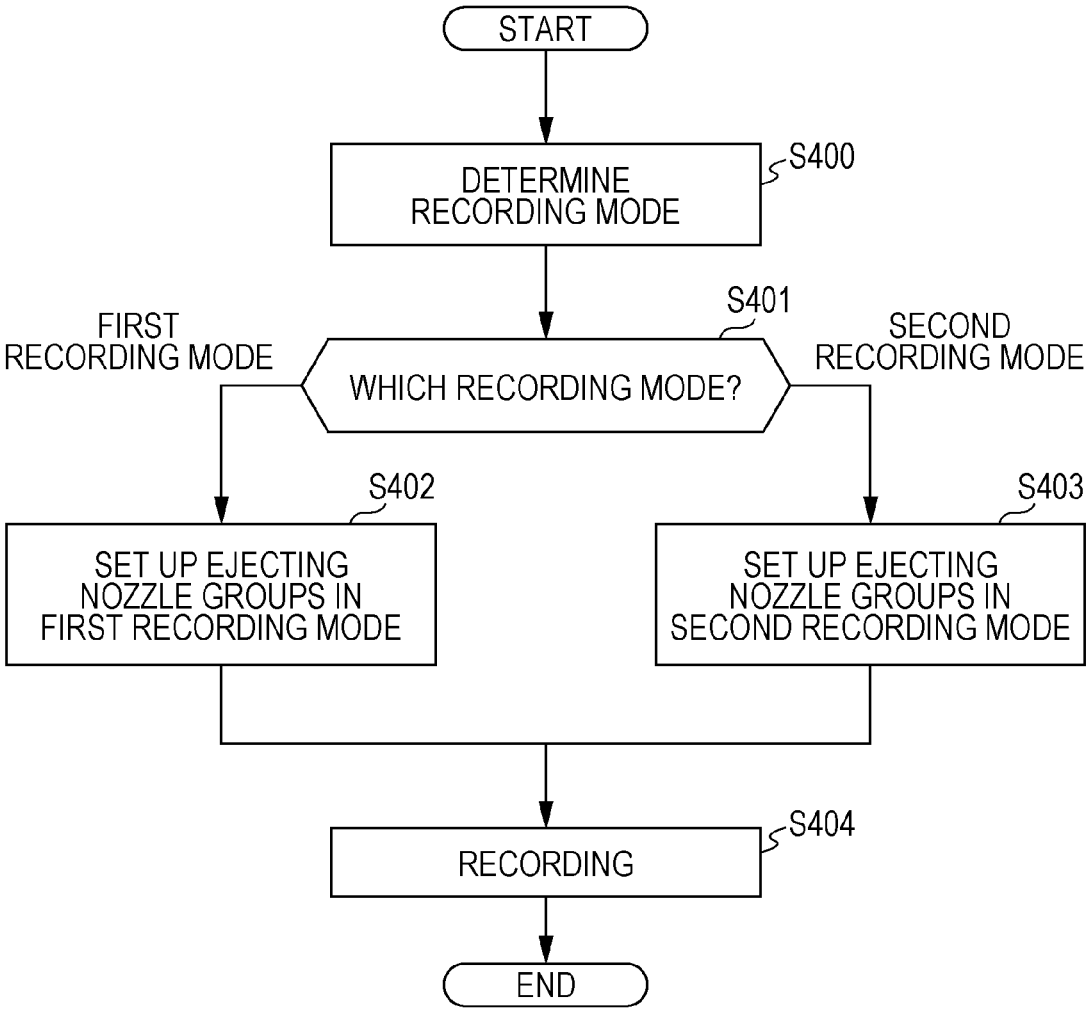
FIG. 5 is a flow chart illustrating an example of a recording process performed with an ink jet recording apparatus for use in an ink jet recording method according to an embodiment.

FIG. 5 is an example of a flow chart illustrating a process that an ink jet recording apparatus performs when producing a recording. To start a recording job, the control section of the ink jet recording apparatus determines the recording mode in step S400. The recording mode is a collection of detailed instructions for the recording job, including the assignment of ejecting and non-ejecting nozzle groups, ejection volumes, the style of liquid firing, and the motion of the recording head and the recording medium. The detailed instructions may further include, for example, the amount of attached treatment liquid.

The recording mode is determined based on an input signal sent from external equipment, such as a computer, to the ink jet recording apparatus, or is determined based on information the user inputs to a user input interface of the ink jet recording apparatus. The input signal from external equipment or the information input by the user may be a direct identification of the recording mode, or may be parameters related to recording, such as the type of recording medium on which the recording is to be produced, the desired recording speed, and the desired image quality. Other types of recording-related parameters can also be used. In the latter case, the ink jet recording apparatus stores inside, for example in its control section, preinstalled matching information as a set of rules that determine the relationship between the recording-related parameters and recording modes, and determines the recording mode with reference to the matching information. Alternatively, the recording mode may be determined using AI (artificial intelligence) technology.

In step S401, the determined recording mode is recognized. In step S402 or S403, the ejecting nozzle groups assigned to the determined recording mode are set up. Step S404 is the execution of recording. Although the number of recording modes in the drawing is two, the first and second recording modes, there may be three or more recording modes.

In this example, the recording apparatus offers different arrangements of ejecting nozzle groups according to recording mode. This advantageously allows the user to perform various types of recording.

1.6. Relative Amounts of Attached Liquids

In the ink jet recording method according to this embodiment, the absolute and relative amounts of treatment liquid and aqueous ink composition attached to the recording medium are not critical. Appropriate amounts can be selected according to the image to be formed.

It is, however, preferred that in the aqueous ink composition attachment step, the recording zone, the zone of the recording medium to which both of the treatment liquid and the ink composition are attached, have a region in which the amount of attached aqueous ink composition is from 5 to 25 mg/inch$^2$. It is more preferred that the recording zone have a region in which the amount of attached ink composition is from 7 to 20 mg/inch$^2$, even more preferably from 10 to 15 mg/inch$^2$. Preferably, the region with such an amount of attached ink composition is the region with the largest amount of attached aqueous ink composition in the recording zone, the zone of the recording medium to which both of the treatment liquid and the ink composition are attached. This advantageously helps produce a highly useful recording.

In the treatment liquid attachment step, the recording zone, the zone of the recording medium to which both of the treatment liquid and the ink composition are attached, preferably has a region in which the amount of attached treatment liquid is from 3% to 50% by mass of that of attached ink composition. It is more preferred that the recording zone have a region in which the proportion of the amount of attached treatment liquid to that of attached ink composition is from 5% to 40% by mass, even more preferably from 7% to 30% by mass. The proportion of the amount of attached treatment liquid to that of attached aqueous ink composition is more preferably 10.0% by mass or more, even more preferably 15.0% by mass or more, still more preferably 20.0% by mass or more. This helps flocculate components of the aqueous ink composition sufficiently, thereby helping enhance the color strength of the image.

Preferably, the region with such an amount of treatment liquid attached is the region with the largest amount of aqueous ink composition attached in the recording zone, the zone of the recording medium to which both of the treatment liquid and the ink composition are attached. This advantageously provides better image quality and abrasion resistance.

2. Examples and Comparative Examples

The following describes aspects of the present disclosure in detail by providing examples, but no aspect of the disclosure is limited to these Examples. In the following, "parts" and "%" are by mass unless stated otherwise.

2.1. Preparation of Treatment Liquids and an Aqueous Ink Composition

Treatment liquids R1 to R23 with different formulae and aqueous ink composition Ink1 were prepared according to the formulae presented in Tables 1 and 2. Each composition was prepared by putting its ingredients, specified in Table 1 or 2, into a container, mixing the ingredients by stirring them for 2 hours with a magnetic stirrer, and then filtering the mixture through a 5-μm membrane filter to remove impurities, such as dust and coarse particles. The values in Tables 1 and 2 are all in % by mass, and the purified water was added to make the total mass of the composition 100%. In preparing the aqueous ink, the pigment was beforehand mixed into water with a dispersant not listed in the tables (water-soluble styrene-acrylic resin) in a pigment to dispersant ratio by mass of 2:1 to give a liquid dispersion, and this liquid dispersion was used to prepare the ink.

TABLE 1

| | | Treatment liquid | | | | | | | | | | | |
|---|---|---|---|---|---|---|---|---|---|---|---|---|---|
| | | R1 | R2 | R3 | R4 | R5 | R6 | R7 | R8 | R9 | R10 | R11 | R12 |
| Flocculant | Mg sulfate | 6.0 | 6.0 | 6.0 | 6.0 | 6.0 | 6.0 | 6.0 | 4.0 | 2.0 | 2.0 | — | — |
| | Mg chloride | — | — | — | — | — | — | — | — | — | — | 6.0 | — |
| | Ca chloride | — | — | — | — | — | — | — | — | — | — | — | 6.0 |
| | K carbonate | — | — | — | — | — | — | — | — | — | — | — | — |
| | Catiomaster PDT-2 | — | — | — | — | — | — | — | — | — | — | — | — |
| | Catiomaster PD-7 | — | — | — | — | — | — | — | — | — | — | — | — |
| | Succinic acid | — | — | — | — | — | — | — | — | — | — | — | — |
| Solvents | 2-Pyrrolidone | 20.0 | 30.0 | 10.0 | 10.0 | 15.0 | 15.0 | 15.0 | 20.0 | 20.0 | 10.0 | 20.0 | 20.0 |
| | Propylene glycol | — | — | — | — | — | — | 10.0 | — | — | — | — | — |
| | 1,3-Butanediol | 10.0 | 10.0 | 20.0 | 30.0 | 10.0 | 10.0 | — | 10.0 | 10.0 | 20.0 | 10.0 | 10.0 |
| | Glycerol | — | — | — | — | 4.0 | 6.0 | 6.0 | — | — | — | — | — |
| Surfactant | BYK348 | 2.0 | 2.0 | 2.0 | 2.0 | 2.0 | 2.0 | 2.0 | 2.0 | 2.0 | 2.0 | 2.0 | 2.0 |
| Pigment (carbon black) | | — | — | — | — | — | — | — | — | — | — | — | — |
| Resin particles (solids content) | | — | — | — | — | — | — | — | — | — | — | — | — |
| Water | | Balance | Balance | Balance | Balance | Balance | Balance | Balance | Balance | Balance | Balance | Balance | Balance |
| Total | | 100 | 100 | 100 | 100 | 100 | 100 | 100 | 100 | 100 | 100 | 100 | 100 |
| Solvent total | | 30.0 | 40.0 | 30.0 | 40.0 | 29.0 | 31.0 | 31.0 | 30.0 | 30.0 | 30.0 | 30.0 | 30.0 |
| Rigid-body pendulum characteristics | Minimum oscillation period (sec) | 0.75 | 0.79 | 0.64 | 0.72 | 0.73 | 0.83 | 0.80 | 0.74 | 0.75 | 0.79 | 0.86 | 0.71 |
| | Maximum oscillation period (sec) | 0.88 | 0.86 | 0.88 | 0.89 | 0.88 | 0.89 | 0.87 | 0.89 | 0.88 | 0.88 | 0.90 | 0.91 |
| | Ratio (min./max.) | 85.2% | 91.9% | 72.7% | 80.9% | 83.0% | 93.3% | 92.0% | 83.1% | 85.2% | 89.8% | 95.6% | 78.0% |

TABLE 2

| | | Treatment liquid | | | | | | | | | | | Ink |
|---|---|---|---|---|---|---|---|---|---|---|---|---|---|
| | | R13 | R14 | R15 | R16 | R17 | R18 | R19 | R20 | R21 | R22 | R23 | Ink1 |
| Flocculant | Mg sulfate | — | — | — | — | — | 6.0 | 6.0 | 6.0 | — | 8.0 | 10.0 | — |
| | Mg chloride | — | — | — | — | — | — | — | — | — | — | — | — |
| | Ca chloride | — | — | — | — | — | — | — | — | — | — | — | — |
| | K carbonate | 6.0 | — | — | — | — | — | — | — | — | — | — | — |
| | Catiomaster PDT-2 | — | 6.0 | — | — | — | — | — | — | — | — | — | — |
| | Catiomaster PD-7 | — | — | 6.0 | 3.0 | — | — | — | — | — | — | — | — |
| | Succinic acid | — | — | — | — | 6.0 | — | — | — | — | — | — | — |
| Solvents | 2-Pyrrolidone | 20.0 | 20.0 | 20.0 | 20.0 | 20.0 | 0.0 | 5.0 | 10.0 | 20.0 | 20.0 | 20.0 | 20.0 |
| | Propylene glycol | — | — | — | — | — | — | — | — | — | — | — | — |
| | 1,3-Butanediol | 10.0 | 10.0 | 10.0 | 10.0 | 10.0 | 20.0 | 5.0 | 10.0 | 10.0 | 10.0 | 10.0 | 10.0 |
| | Glycerol | — | — | — | — | — | — | — | — | — | — | — | — |
| Surfactant | BYK348 | 2.0 | 2.0 | 2.0 | 2.0 | 2.0 | 2.0 | 2.0 | 2.0 | 2.0 | 2.0 | 2.0 | 1.0 |
| Pigment (carbon black) | | — | — | — | — | — | — | — | — | — | — | — | 3.0 |
| Resin particles (solids content) | | — | — | — | — | — | — | — | — | — | — | — | 3.0 |
| Water | | Balance | Balance | Balance | Balance | Balance | Balance | Balance | Balance | Balance | Balance | Balance | Balance |
| Total | | 100 | 100 | 100 | 100 | 100 | 100 | 100 | 100 | 100 | 100 | 100 | 100 |
| Solvent total | | 30.0 | 30.0 | 30.0 | 30.0 | 30.0 | 20.0 | 10.0 | 20.0 | 30.0 | 30.0 | 30.0 | 30.0 |
| Rigid-body pendulum characteristics | Minimum oscillation period (sec) | 0.71 | 0.86 | 0.87 | 0.87 | 0.81 | 0.15 | 0.15 | 0.59 | 0.88 | 0.25 | 0.27 | — |
| | Maximum oscillation period (sec) | 0.90 | 0.93 | 0.90 | 0.94 | 0.91 | 0.85 | 0.87 | 0.90 | 0.93 | 0.89 | 0.91 | — |
| | Ratio (min./max.) | 78.9% | 92.5% | 96.7% | 92.6% | 89.0% | 17.6% | 17.2% | 65.6% | 94.6% | 28.1% | 29.7% | — |

Major ingredients in Tables 1 and 2 were as follows.

Flocculants (In the examples in which a hydrate was used, the percentage in the table excludes the water of hydration.)

Mg sulfate: Magnesium sulfate heptahydrate

Mg chloride: Magnesium chloride hexahydrate

Ca chloride: Calcium chloride dihydrate

K carbonate: Potassium carbonate

Catiomaster® PDT-2: A polyamine resin (epichlorohydrin-amine derivative resin), Yokkaichi Chemical, Co., Ltd.

Catiomaster® PD-7: A polyamine resin (epichlorohydrin-amine derivative resin), Yokkaichi Chemical, Co., Ltd.

Surfactant

BYK348: Silicone surfactant "BYK348," BYK

Pigment

Carbon black: C.I. Pigment Black 7

Resin Particles

Resin particles: A styrene-acrylic resin prepared as follows

Preparation of an Emulsion of Resin Particles

An emulsion of resin particles was prepared. The resin content was 40% by mass on a solids basis. In the polymerization process for synthesizing the resin, the acrylic monomer and its percentage were selected primarily to make the overall acid value of the resulting resin relatively high. By virtue of this, the resin particles were highly reactive.

2.2. Testing 2.2.1. Rigid-Body Pendulum Characteristics Test

The treatment liquid in each example was characterized using "A&D Co., Ltd." "RPT-3000W" ISO 12013-1- and ISO 12013-2-compliant rigid-body pendulum characteristics tester. With the frame being "FRB-100," the measuring section's shape being "RBP060," four spacers (2.7 g each) on the frame (two at each end of the frame), and the angle of swing set to 0.40 degrees, changes in the free oscillations of the pendulum were measured.

In each example, the treatment liquid was applied to a 24 mm×40 mm area on a glass plate (Matsunami Glass Ind.) to a thickness of 20.0 μm using a bar coater. The glass plate was then immediately placed on a sample mount equipped with a heating mechanism (CHB-100). With the pendulum on the surface coated with the treatment liquid, the glass plate was heated at a rate at which its temperature would reach 35.0° C. in 1 minute. The oscillation period of the pendulum was measured after 35.0° C. was reached. During this rigid-body pendulum characteristics test, the temperature and humidity in the room were controlled to stay normal (from 22° C. to 25° C. and from 35% to 60% RH).

For measurement, the pendulum was held at its maximum amplitude using an electromagnet for 2.0 seconds, and then the electric current to the electromagnet was turned off to let the pendulum swing freely. The displacement of the pendulum was monitored using a displacement sensor for 4.0 seconds of free oscillations. After 4.0 seconds passed, an electric current was distributed to the electromagnet to hold the pendulum at its maximum amplitude. Two seconds later, the electric current to the electromagnet was turned off to let the pendulum swing freely, and the displacement was measured for the next 4.0 seconds of free oscillations. This cycle of measurement, 6 seconds per cycle, was repeated. That is, ten cycles of measurement were performed per minute. The measurement was repeated for 20.0 minutes, providing data on changes in the pendulum's oscillation period over time.

From the data obtained, the minimum and maximum oscillation periods of the rigid-body pendulum were determined for the 20.0-minute period after 35.0° C. was reached. The results are presented in Tables 1 and 2. Tables 1 and 2 also include the ratio of the minimum oscillation period to the maximum oscillation period (minimum/maximum) (%).

2.2.2. Recording Test

Ink Jet Recording Apparatus

Seiko Epson SC-s80650 (Seiko Epson Corporation) was modified, for example by attaching dryers such as an aeration fan and an IR heater like those illustrated in FIG. 1 (hereinafter referred to as "modified SC-S80650"). The modified SC-S80650 was used loaded with the treatment liquid in each example and the aqueous ink composition.

The arrangement of nozzle lines on the ink jet head was as in FIG. 4. Each nozzle line was formed by 360 nozzles.

Ink Jet Recording Method

The recording medium was a sheet of polyvinyl chloride (Sumitomo 3M Ltd., "IJ-40"). The recording apparatus had a platen heater, and the platen heater was turned on to heat the recording medium during a recording job.

The recording apparatus in this state was fed with the recording medium, and the treatment liquid and aqueous ink composition in the recording apparatus were ejected and attached to the heated recording medium to record a 5×5 cm pattern. The ejection of the aqueous ink composition was customized so that the amount of attached ink would be 15 mg/inch$^2$. The treatment liquid was attached to cover the pattern drawn with the aqueous ink. The amount of attached treatment liquid was as in the tables.

After the attachment of the treatment liquid and ink, the recording medium was dried using a drying heater downstream of the platen heater for approximately 2 minutes, finishing a recording. The temperature to which the surface of the recording medium was heated by the drying heater is presented in Tables 3 to 5 (curing temperature).

The style of recording was selected from the following three.

Style 1: Concurrent firing. A treatment liquid and an aqueous ink composition are ejected together while the head is scanning (both the treatment liquid and aqueous ink composition adhere to a particular area of the recording medium in one pass), and all nozzles in the treatment liquid nozzle line and in the aqueous ink composition nozzle line are ejecting nozzles. Specifically, the first nozzle line 15*a* in FIG. 4 was for the treatment liquid, and all nozzles in this line were ejecting nozzles. The second nozzle line 15*b* was for the aqueous ink composition, and all nozzles in this line were ejecting nozzles.

Style 2: Advance firing. A treatment liquid is attached to a particular area of the recording medium in a head scan, and an aqueous ink composition is attached to the same area in a later scan. Substantially half of the nozzles in the treatment liquid nozzle line and in the aqueous ink composition nozzle line are ejecting nozzles, and the ejecting nozzle groups in the two lines do not overlap when projected in the main scanning direction.

Specifically, the first nozzle line 15*a* in FIG. 4 was for the treatment liquid, and the nozzle subset 15*aa* was an ejecting nozzle group. The second nozzle line 15*b* was for the aqueous ink composition, and the nozzle subset 15*bb* was an ejecting nozzle group.

Style 3: Advance+Concurrent firing. In each of a treatment liquid nozzle line and an aqueous ink composition nozzle line, two out of three nozzles are ejecting nozzles. In the treatment liquid nozzle line, the upstream two-thirds of the nozzles are ejecting nozzles. In the aqueous ink composition nozzle line, the downstream two-thirds of the nozzles are ejecting nozzles. The two ejecting nozzle groups are therefore partially in the same position and partially in different positions when projected in the main scanning direction. Style 3 is the combination of style 1 and style 2. There is a pass in which both the treatment liquid and aqueous ink composition are attached to a particular area of the recording medium, and there is also a pair of scans in which the treatment liquid is attached to a particular area of the recording medium in a scan, and the aqueous ink composition is attached to the same area in a later scan. Specifically, the first nozzle line 15*a* in FIG. 4 was for the treatment liquid, and the nozzles in the nozzle subset 15*aa* and part of the nozzle subset 15*ab* were assigned to an ejecting nozzle group so that the upstream two-thirds, positioned upstream in the sub-scanning direction, of the nozzles in the first nozzle line 15*a* would be ejecting nozzles. The second nozzle line 15*b* was for the ink composition, and the nozzles in the nozzle subset 15*bb* and part of the nozzle subset 15*ba* were assigned to an ejecting nozzle group so that the downstream two-thirds, positioned downstream in the sub-scanning direction, of the nozzles in the second nozzle line 15*b* would be ejecting nozzles.

In all recording styles, four-pass recording was performed for both the treatment liquid and ink. That is, the length of one sub-scan was set to approximately ¼ of the length of the treatment liquid- and ink-ejecting nozzle groups in the sub-scanning direction.

The temperature during the attachment steps is presented in Tables 3 to 5. Aeration, conduction, and radiation dryers were used in the attachment steps, and "Y" in the tables means that that type of dryer was used in that example. The velocity of air blow from the aeration drier was 2 m/s on the recording medium. The air was at the ordinary temperature (25° C.) in most examples, but in the example in which aeration was the only drying mechanism, the air was warmed to achieve the attachment temperature specified in the table.

The conduction dryer was the platen heater. The radiation dryer was infrared radiation (IR) emitted down to the recording medium.

2.2.3. Bleed

The pattern on a recording produced as described above was visually inspected, and the "bleed" was graded according to the criteria below. The results are presented in Tables 3 to 5.

A: The inside of the pattern was even in density, and there was no ink bleed along the edges of the pattern.

B: The inside of the pattern was even in density, but there was some ink bleed along the edges of the pattern.

C: The inside of the pattern was noticeably uneven in density.

2.2.4. White Haze

A recording produced as described above was left at loop temperature for a day, the pattern thereon was visually inspected, and the "white haze" was graded according to the criteria below. The results are presented in Tables 3 to 5.

A: There is no visible white haze. The pattern looks the same before and after its surface is wiped with a cotton wiper.

B: Minor white haze is observed. The pattern looks slightly different before and after its surface is wiped with a cotton wiper.

C: White haze is noticeable. The pattern looks very different before and after its surface is wiped with a cotton wiper.

2.2.5. Ejection Reliability

A nozzle check pattern was printed for the ink nozzle group in its initial state under 40° C. and 20% RH conditions, and all nozzles ejected the ink normally. A cotton wiper was soaked with the treatment liquid, and the aqueous ink composition nozzle line on the nozzle face of the head was rubbed with the wiper manually and gently. This made substantially half of the nozzles unable to eject the ink. With these nozzles in that disabled state, recording was performed for 20 minutes under the same conditions as in the recording test. Then the disabled nozzles were cleaned by making the nozzle line aspirate 1 cc of liquid. A nozzle check pattern for the aqueous ink composition was printed, and ejection reliability was graded based on the percentage of non-ejecting nozzles relative to the initial state according to the criteria below. The results are presented in Tables 3 to 5.

A: 0%

B: More than 0% but not more than 3%

C: More than 3% but not more than 7%

D: More than 7%

2.2.6. Abrasion Resistance

The patterned area of a recording produced as described above was subjected to 60 to-and-fro strokes of rubbing under a load of 330 g with a friction finger of AB-301 Color Fastness Rubbing Tester (a trade name of a Tester Sangyo product) fitted with a piece of cotton fabric (as defined in JIS L 0803). The patterned area of the recording medium was visually inspected for peeling, and abrasion resistance was graded according to the criteria below. The results are presented in Tables 3 to 5.

A: There was no flaw in or peeling of the pattern, and no ink transferred to the cotton fabric.

B: There was no noticeable flaw in or peeling of the pattern, but some ink transferred to the cotton fabric.

C: There were noticeable flaws in or noticeable peeling of the pattern.

2.2.7. Recording Speed

A predetermined volume of recording (based on the length of the recording medium in the sub-scanning direction) was performed, and the time required was measured. The recording speed in each example was graded according to the criteria below, with that in style 1 as 100%. The results are presented in Tables 3 to 5. It should be noted that the recording time depends on the length of the ejecting nozzle groups.

A: 100%

B: Less than 100% but more than 50%

C: 50% or less

TABLE 3

| | Example 1 | Example 2 | Example 3 | Example 4 | Example 5 | Example 6 | Example 7 | Example 8 |
|---|---|---|---|---|---|---|---|---|
| Treatment liquid | R1 | R2 | R3 | R4 | R5 | R6 | R7 | R8 |
| Recording style | Style 1 | Style 1 | Style 1 | Style 1 | Style 1 | Style 1 | Style 1 | Style 1 |
| Amount of treatment liquid (% by mass) (relative to ink) | 10.0 | 10.0 | 10.0 | 10.0 | 10.0 | 10.0 | 10.0 | 10.0 |

TABLE 3-continued

| | | | | | | | | | |
|---|---|---|---|---|---|---|---|---|---|
| Attachment temperature (° C.) | | 35.0 | 35.0 | 35.0 | 35.0 | 35.0 | 35.0 | 35.0 | 35.0 |
| Dryer(s) in attachment steps | Conduction | Y | Y | Y | Y | Y | Y | Y | Y |
| | Aeration | Y | Y | Y | Y | Y | Y | Y | Y |
| | Radiation | — | — | — | — | — | — | — | — |
| Curing temperature (° C.) | | 90.0 | 90.0 | 90.0 | 90.0 | 90.0 | 90.0 | 90.0 | 90.0 |
| Bleed | | A | A | A | A | A | A | A | A |
| White haze | | A | A | B | A | A | A | A | A |
| Ejection reliability | | A | A | A | A | A | A | A | A |
| Abrasion resistance | | A | A | B | C | B | B | B | A |
| Recording speed | | A | A | A | A | A | A | A | A |

| | | Example 9 | Example 10 | Example 11 | Example 12 | Example 13 | Example 14 | Example 15 | Example 16 |
|---|---|---|---|---|---|---|---|---|---|
| Treatment liquid | | R9 | R10 | R11 | R12 | R13 | R14 | R15 | R16 |
| Recording style | | Style 1 | Style 1 | Style 1 | Style 1 | Style 1 | Style 1 | Style 1 | Style 1 |
| Amount of treatment liquid (% by mass) (relative to ink) | | 10.0 | 10.0 | 10.0 | 10.0 | 10.0 | 10.0 | 10.0 | 10.0 |
| Attachment temperature (° C.) | | 35.0 | 35.0 | 35.0 | 35.0 | 35.0 | 35.0 | 35.0 | 35.0 |
| Dryer(s) in attachment steps | Conduction | Y | Y | Y | Y | Y | Y | Y | Y |
| | Aeration | Y | Y | Y | Y | Y | Y | Y | Y |
| | Radiation | — | — | — | — | — | — | — | — |
| Curing temperature (° C.) | | 90.0 | 90.0 | 90.0 | 90.0 | 90.0 | 90.0 | 90.0 | 90.0 |
| Bleed | | B | B | A | A | A | A | A | B |
| White haze | | A | A | A | A | A | A | A | A |
| Ejection reliability | | A | A | A | A | A | C | C | B |
| Abrasion resistance | | A | A | B | C | C | A | A | A |
| Recording speed | | A | A | A | A | A | A | A | A |

TABLE 4

| | | Example 17 | Example 18 | Example 19 | Example 20 | Example 21 | Example 22 | Example 23 | Example 24 |
|---|---|---|---|---|---|---|---|---|---|
| Treatment liquid | | R17 | R6 | R1 | R9 | R5 | R10 | R16 | R6 |
| Recording style | | Style 1 | Style 1 | Style 1 | Style 1 | Style 1 | Style 1 | Style 1 | Style 1 |
| Amount of treatment liquid (% by mass) (relative to ink) | | 10.0 | 5.0 | 20.0 | 20.0 | 20.0 | 30.0 | 30.0 | 10.0 |
| Attachment temperature (° C.) | | 35.0 | 35.0 | 35.0 | 35.0 | 35.0 | 35.0 | 35.0 | 45.0 |
| Dryer(s) in attachment steps | Conduction | Y | Y | Y | Y | Y | Y | Y | Y |
| | Aeration | Y | Y | Y | Y | Y | Y | Y | Y |
| | Radiation | — | — | — | — | — | — | — | — |
| Curing temperature (° C.) | | 90.0 | 90.0 | 90.0 | 90.0 | 90.0 | 90.0 | 90.0 | 90.0 |
| Bleed | | B | B | A | A | A | A | A | A |
| White haze | | A | A | B | B | B | B | B | B |
| Ejection reliability | | A | A | A | A | A | A | B | C |
| Abrasion resistance | | A | A | B | B | B | C | C | B |
| Recording speed | | A | A | A | A | A | A | A | A |

| | | Example 25 | Example 26 | Example 27 | Example 28 | Example 29 | Example 30 | Example 31 |
|---|---|---|---|---|---|---|---|---|
| Treatment liquid | | R6 | R3 | R3 | R3 | R3 | R3 | R3 |
| Recording style | | Style 1 | Style 1 | Style 1 | Style 1 | Style 1 | Style 1 | Style 3 |
| Amount of treatment liquid (% by mass) (relative to ink) | | 10.0 | 10.0 | 10.0 | 10.0 | 10.0 | 10.0 | 10.0 |
| Attachment temperature (° C.) | | 35.0 | 35.0 | 35.0 | 35.0 | 40.0 | 35.0 | 35.0 |
| Dryer(s) in attachment steps | Conduction | Y | Y | — | — | — | Y | Y |
| | Aeration | Y | Y | Y | Y | Y | — | Y |
| | Radiation | — | — | Y | — | — | — | — |
| Curing temperature (° C.) | | 70.0 | 110.0 | 90.0 | 90.0 | 90.0 | 90.0 | 90.0 |
| Bleed | | A | A | B | B | A | A | A |
| White haze | | B | A | A | A | B | B | A |
| Ejection reliability | | A | A | A | A | B | B | A |
| Abrasion resistance | | C | A | B | B | B | B | B |
| Recording speed | | A | A | A | A | A | A | B |

TABLE 5

| | | Comparative Example 1 | Comparative Example 2 | Comparative Example 3 | Comparative Example 4 | Comparative Example 5 | Comparative Example 6 | Reference Example 1 | Reference Example 2 | Reference Example 3 | Reference Example 4 |
|---|---|---|---|---|---|---|---|---|---|---|---|
| Treatment liquid | | R18 | R19 | R20 | R21 | R22 | R23 | R6 | R6 | R19 | R20 |
| Recording style | | Style 1 | Style 1 | Style 1 | Style 1 | Style 1 | Style 1 | Style 2 | Style 2 | Style 2 | Style 2 |
| Amount of treatment liquid (% by mass) (relative to ink) | | 10.0 | 10.0 | 10.0 | 10.0 | 10.0 | 10.0 | 10.0 | 10.0 | 10.0 | 10.0 |
| Attachment temperature (° C.) | | 35.0 | 35.0 | 35.0 | 35.0 | 35.0 | 35.0 | 35.0 | 45.0 | 35.0 | 35.0 |
| Dryer(s) in attachment steps | Conduction | Y | Y | Y | Y | Y | Y | Y | Y | Y | Y |
| | Aeration | Y | Y | Y | Y | Y | Y | Y | Y | Y | Y |
| | Radiation | — | — | — | — | — | — | — | — | — | — |
| Curing temperature (° C.) | | 90.0 | 90.0 | 90.0 | 90.0 | 90.0 | 90.0 | 90.0 | 90.0 | 90.0 | 90.0 |
| Bleed | | A | A | A | C | A | A | A | A | A | A |
| White haze | | C | C | C | A | C | C | A | A | A | A |
| Ejection reliability | | B | C | B | A | A | A | A | A | A | A |
| Abrasion resistance | | C | C | A | A | A | B | A | A | C | A |
| Recording speed | | A | A | A | A | A | A | C | C | C | C |

2.3. Test Results

In the Examples, the treatment liquid contained a flocculant; when the treatment liquid was tested using a rigid-body pendulum characteristics tester at 35.0° C. for 20 minutes, the minimum oscillation period of the rigid-body pendulum was not less than 70.0% of the maximum oscillation period of the rigid-body pendulum; and the treatment liquid-ejecting nozzle group overlapped the ink composition-ejecting nozzle group when projected in the main scanning direction. With such treatment liquids, the Examples were all superior in preventing bleed and white haze. By contrast, the Comparative Examples, in which the treatment liquid did not meet all these conditions, were inferior in bleed or white haze. The following discusses this in detail.

From Examples 1 to 4, treatment liquids with a higher ratio between oscillation periods were superb in preventing white haze.

As stated, white haze is masked when the organic solvent content of the treatment liquid is high. A possible mechanism behind this is that since the treatment liquid is rich in solvent(s) in which its crystallizable component is insoluble, the nucleation upon water evaporation is scattered, rather than concentrating, on the surface of the recording medium, and the crystal nuclei are therefore less likely to grow large than with a low organic solvent content.

Even after a metal salt separates out on the surface of the image, moreover, some of the organic solvent(s) as a component of the treatment liquid remains therearound. The residual organic solvent soaks into the crystals, reducing the difference in refractive index. As a result, the inventor presumed, the scattering of light is reduced on the matter that has separated out on the surface of the image, and the white haze becomes less visible.

From Examples 5 to 7, treatment liquids containing glycerol tended to be superb in preventing white haze but affect abrasion resistance.

From Examples 8 to 10, treatment liquids with a low flocculant content were superb in preventing white haze but somewhat inferior in preventing bleed.

From Examples 11 to 17, even treatment liquids containing a flocculant other than magnesium sulfate effectively prevented bleed and white haze. It was found that ejection is somewhat unreliable when the flocculant is a cationic polymer.

From Examples 18 to 23, smaller amounts of attached treatment liquid led to particularly effective prevention of white haze and superb abrasion resistance, and greater amounts led to particularly effective prevention of bleed.

From Examples 25 and 26, a higher curing temperature resulted in particularly effective prevention of white haze.

From Examples 27 to 31, aeration drying is superior particularly in preventing bleed, but was somewhat inferior in preventing white haze. Example 29, in which aeration drying was not performed, was superior in preventing bleed by virtue of a relatively high attachment temperature, but was inferior in preventing white haze.

From Comparative Examples 1 to 3, 5, and 6, treatment liquids with a ratio between oscillation periods less than 70.0% were inferior in preventing white haze. From Comparative Example 4, a treatment liquid containing no flocculant was inferior in preventing bleed.

In the Reference Examples, the treatment liquid-ejecting nozzle group and the aqueous ink composition-ejecting nozzle group did not overlap when projected in the main scanning direction. The Reference Examples were all superior in preventing bleed and white haze but inferior in recording speed.

The present disclosure is not limited to the above embodiments, and many variations are possible. For example, the present disclosure embraces configurations substantially identical to those described in the embodiments (e.g., configurations identical in function, methodology, and results to or having the same goal and offering the same advantages as the described ones). The present disclosure also includes configurations created by changing any nonessential part of those described in the above embodiments. Furthermore, the present disclosure encompasses configurations identical in operation and effect to or capable of fulfilling the same purposes as those described in the above embodiments. Configurations obtained by adding any known technology to those described in the embodiments are also part of the present disclosure.

What is claimed is:

1. An ink jet recording method comprising:

a treatment liquid attachment step including attaching a treatment liquid containing at least one flocculant to a recording medium; and an ink attachment step including attaching an aqueous ink composition to the recording medium, wherein:

the treatment liquid attachment step and the ink attachment step are performed through a plurality of main scans and a plurality of sub-scans, a main scan being a movement of a recording head in a main scanning direction, and a sub-scan being a movement of the recording medium in a sub-scanning direction as a direction crossing the main scanning direction;

the recording head has:

a first ejecting nozzle group as a line of nozzles arranged in the sub-scanning direction and configured to eject the treatment liquid; and a second ejecting nozzle group as a line of nozzles arranged in the sub-scanning direction and configured to eject the aqueous ink composition;

the first ejecting nozzle group overlaps, at least in a portion, the second ejecting nozzle group when projected in the main scanning direction; and when the treatment liquid is tested using a rigid-body pendulum characteristics tester at 35.0° C. for 20.0 minutes, a minimum oscillation period of the rigid-body pendulum is 70.0% or more of a maximum oscillation period of the rigid-body pendulum.

2. The ink jet recording method according to claim 1, wherein the treatment liquid is an aqueous treatment liquid and contains an organic solvent in an amount of 25.0% by mass or more of a total mass of the treatment liquid.

3. The ink jet recording method according to claim 1, wherein the treatment liquid contains the flocculant in an amount of 4.0% by mass or more and 20.0% by mass or less of a total mass of the treatment liquid.

4. The ink jet recording method according to claim 1, wherein the treatment liquid contains one or two or more of polyvalent metal salts, cationic polymers, and organic acids as the flocculant.

5. The ink jet recording method according to claim 1, wherein in a region of the recording medium, an amount of the treatment liquid attached thereto is 10.0% by mass or more of an amount of the aqueous ink composition attached thereto.

6. The ink jet recording method according to claim 1, further comprising a postheating step, after the treatment liquid attachment step and the ink attachment step, including heating the recording medium with the attached treatment liquid and aqueous ink composition thereon, wherein a surface temperature of the recording medium in the postheating step is 80.0° C. or more.

7. The ink jet recording method according to claim 1, further comprising a drying step including drying, using a drying mechanism, the aqueous ink composition and treatment liquid attached to the recording medium in the ink attachment step and the treatment liquid attachment step, respectively.

8. The ink jet recording method according to claim 7, wherein the drying mechanism includes an aeration drying mechanism.

9. The ink jet recording method according to claim 1, wherein a surface temperature of the recording medium in the treatment liquid attachment step is 45.0 or less.

10. The ink jet recording method according to claim 1, wherein the treatment liquid contains a nitrogen-containing solvent.

11. The ink jet recording method according to claim 1, wherein a percentage, in the treatment liquid, of organic solvents having a normal boiling point exceeding 280.0° C. is 1.0% by mass or less.

12. The ink jet recording method according to claim 1, wherein the recording medium is a low-absorbent recording medium or non-absorbent recording medium.

13. The ink jet recording method according to claim 1, wherein the aqueous ink composition is a black ink.

14. An ink jet recording apparatus comprising:

a recording head having:

a first ejecting nozzle group as a line of nozzles arranged in a sub-scanning direction as a direction of movement of a recording medium and configured to eject a treatment liquid; and a second ejecting nozzle group as a line of nozzles arranged in the sub-scanning direction and configured to eject an aqueous ink composition, wherein:

when the treatment liquid is tested using a rigid-body pendulum characteristics tester at 35.0° C. for 20.0 minutes, a minimum oscillation period of the rigid-body pendulum is 70.0% or more of a maximum oscillation period of the rigid-body pendulum;

the recording head, when performing a recording job, attaches the treatment liquid and the aqueous ink composition to the recording medium through a plurality of main scans and a plurality of sub-scans, a main scan being a movement of the recording head in a main scanning direction as a direction crossing the sub-scanning direction, and a sub-scan being a movement of the recording medium in the sub-scanning direction; and the second ejecting nozzle group overlaps, at least in a portion, the first ejecting nozzle group when projected in the main scanning direction.

15. A treatment liquid comprising a flocculant, wherein:

when the treatment liquid is tested using a rigid-body pendulum characteristics tester at 35.0° C. for 20.0 minutes, a minimum oscillation period of the rigid-body pendulum is 70.0% or more of a maximum oscillation period of the rigid-body pendulum; and the treatment liquid is for use in an ink jet recording method including:

a treatment liquid attachment step including attaching the treatment liquid to a recording medium; and an ink attachment step including attaching an aqueous ink composition to the recording medium, wherein:

the treatment liquid attachment step and the ink attachment step are performed through a plurality of main scans and a plurality of sub-scans, a main scan being a movement of a recording head in a main scanning direction, and a sub-scan being a movement of the recording medium in a sub-scanning direction as a direction crossing the main scanning direction;

the recording head has:

a first ejecting nozzle group as a line of nozzles arranged in the sub-scanning direction and configured to eject the treatment liquid; and a second ejecting nozzle group as a line of nozzles arranged in the sub-scanning direction and configured to eject the aqueous ink composition; and the first ejecting nozzle group overlaps, at least in a portion, the second ejecting nozzle group when projected in the main scanning direction.

* * * * *